US008845060B2

(12) United States Patent
Azuma et al.

(10) Patent No.: US 8,845,060 B2
(45) Date of Patent: Sep. 30, 2014

(54) PRINTING APPARATUS AND PROCESSING METHOD THEREOF

(71) Applicant: Canon Kabushiki Kaisha, Tokyo (JP)

(72) Inventors: Satoshi Azuma, Kawasaki (JP); Yoshiaki Murayama, Tokyo (JP); Takuya Fukasawa, Kawasaki (JP); Minoru Teshigawara, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 44 days.

(21) Appl. No.: 13/647,783

(22) Filed: Oct. 9, 2012

(65) Prior Publication Data

US 2013/0100189 A1 Apr. 25, 2013

(30) Foreign Application Priority Data

Oct. 20, 2011 (JP) ..... 2011-231098
Oct. 21, 2011 (JP) ..... 2011-232123
Sep. 24, 2012 (JP) ..... 2012-210151

(51) Int. Cl.
*B41J 29/38* (2006.01)
*B41J 2/21* (2006.01)
*B41J 2/165* (2006.01)

(52) U.S. Cl.
CPC ..... *B41J 2/2142* (2013.01); *B41J 2/2146* (2013.01); *B41J 2/16579* (2013.01)
USPC ..... 347/14; 347/19

(58) Field of Classification Search
CPC ..... B41J 29/393; B41J 2029/3935; B41J 2/0451; B41J 2/04596; B41J 2/2139; B41J 2/16579; B41J 2/2142
USPC ..... 347/14, 19, 37, 15, 40–43
See application file for complete search history.

(56) References Cited

U.S. PATENT DOCUMENTS 6,834,927 B2 * 12/2004 Yashima et al. ..... 347/15
7,131,712 B2 11/2006 Kimura
7,281,784 B2 10/2007 Eguchi et al.
7,681,997 B2 3/2010 Kusunoki et al.

(Continued)

FOREIGN PATENT DOCUMENTS

CN 1483583 A 3/2004
CN 1807097 A 7/2006

(Continued)

OTHER PUBLICATIONS

Communication re Japanese Patent Application No. 2012-210151, Japanese Patent Office, dated Feb. 15, 2013.

(Continued)

*Primary Examiner* — Thinh Nguyen
(74) *Attorney, Agent, or Firm* — Fitzpatrick, Cella, Harper & Scinto

(57) ABSTRACT

A printing apparatus includes a printhead configured to array a nozzle array in which a plurality of nozzles for discharging ink are arrayed in the first direction, a reading unit configured to read, as a plurality of luminance values aligned in a nozzle arrayed direction, an inspection pattern formed by discharging ink from the plurality of nozzles of the printhead, a calculation unit configured to calculate a plurality of difference values each by calculating a difference between two luminance values spaced apart by a predetermined number of luminance values, and an analysis unit configured to analyze an ink discharge state in the plurality of nozzles based on the plurality of difference values.

31 Claims, 33 Drawing Sheets

(56) References Cited

U.S. PATENT DOCUMENTS

| | | | | |
|---|---|---|---|---|
| 8,696,083 | B2 * | 4/2014 | Koga et al. | 347/16 |
| 2010/0328383 | A1 | 12/2010 | Yoshikawa et al. | |
| 2011/0249062 | A1 | 10/2011 | Nakano et al. | |
| 2012/0033006 | A1 | 2/2012 | Murayama et al. | |
| 2012/0050378 | A1 * | 3/2012 | Kido | 347/19 |
| 2012/0069067 | A1 | 3/2012 | Torigoe et al. | |

FOREIGN PATENT DOCUMENTS

| | | | |
|---|---|---|---|
| CN | 101085571 | A | 12/2007 |
| EP | 2308683 | A1 | 4/2011 |
| JP | 2003-094627 | A | 4/2003 |
| JP | 2004-009747 | A | 1/2004 |
| JP | 2004-237697 | A | 8/2004 |
| JP | 2006-168152 | A | 6/2006 |
| JP | 2008-221625 | A | 9/2008 |
| JP | 2009-006560 | A | 1/2009 |
| JP | 2010-058361 | A | 3/2010 |
| JP | 2011-098546 | A | 5/2011 |
| JP | 2011-101964 | A | 5/2011 |

OTHER PUBLICATIONS

European Search Report, European Patent Application No. 12006782.2, dated Mar. 11, 2013.

Office Action—Japanese Patent Appln. No. 2012-210151, Mar. 18, 2013, Japanese Patent Office.

Notification of First Office Action in Chinese Patent Application No. 201210404442.3 dated May 30, 2014, State Intellectual Property Office of the Peoples Republic of China.

* cited by examiner

PRINTING APPARATUS AND PROCESSING METHOD THEREOF

BACKGROUND OF THE INVENTION

1. Field of the Invention

The present invention relates to a printing apparatus and processing method thereof.

2. Description of the Related Art

Recently, it has become possible to manufacture high-density, long printheads. Such a printhead is generally called a full-line head or the like, and can complete an image by one printing scan in a wide printing area.

The full-line head has a larger number of nozzles than a conventional serial scan head. It is difficult to maintain the discharge state of all nozzles normally, and a discharge failure nozzle is highly likely to be generated. Causes of generating a discharge failure nozzle include various factors such as paper dust or mote attaching near a nozzle, attachment of an ink mist, an increase in ink viscosity, and mixing of bubbles or dust into ink.

Sudden generation of a discharge failure nozzle during the printing operation leads to degradation in image quality. This boosts the demand for a technique to allow quick detection of a discharge failure nozzle and maintain image quality. As a method for detecting a discharge failure nozzle, a technique disclosed in Japanese Patent Laid-Open No. 2011-101964 has been known.

In Japanese Patent Laid-Open No. 2011-101964, a line type inkjet head prints by a plurality of lines for each color, and a line sensor acquires each density data. Accumulated density data is acquired by accumulating density data for a plurality of lines for each color. The accumulated density data is compared with a threshold to specify a discharge failure nozzle.

The line sensor used in Japanese Patent Laid-Open No. 2011-101964 is formed by arraying a plurality of CCD elements in one line. If the detection sensitivities of these CCD elements are not constant, accurate density data cannot be measured, and a discharge failure nozzle will fail to be specified. In this case, neither printhead recovery processing nor image supplement using another nozzle can be performed, degrading the image quality.

The present invention has been made to solve the above problems, and has as its object to provide a high-reliability inkjet printing apparatus capable of accurately specifying a discharge failure nozzle and maintaining the image quality even if the detection sensitivity of a line sensor configured to detect an inspection pattern is not constant.

SUMMARY OF THE INVENTION

Accordingly, the present invention is conceived as a response to the above-described disadvantages of the conventional art.

For example, a printing apparatus and processing method thereof according to this invention are capable of providing a high-reliability inkjet printing apparatus capable of specifying a discharge failure nozzle and maintaining the image quality even if the detection sensitivity of a line sensor configured to detect an inspection pattern is not constant.

According to one aspect of the present invention, there is provided a printing apparatus comprising: a printhead configured to array a nozzle array in which a plurality of nozzles for discharging ink are arrayed in a first direction; a reading unit configured to read, as a plurality of luminance values aligned in a nozzle arrayed direction, an inspection pattern formed by discharging ink from the plurality of nozzles of the printhead; a calculation unit configured to calculate a plurality of difference values each by calculating a difference between the two luminance values spaced apart by a predetermined number of luminance values; and an analysis unit configured to analyze a ink discharge state in the plurality of nozzles based on the plurality of difference values.

According to one aspect of the present invention, there is provided a printing method applied to a printing apparatus including a printhead configured to array a nozzle array in which a plurality of nozzles for discharging ink are arrayed in a first direction, comprising: reading, as a plurality of luminance values aligned in a nozzle arrayed direction, an inspection pattern formed by discharging ink from the plurality of nozzles of the printhead; calculating a plurality of difference values each by calculating a difference between the two luminance values spaced apart by a predetermined number of luminance values; and analyzing a ink discharge state in the plurality of nozzles based on the plurality of difference values.

Further features of the present invention will become apparent from the following description of exemplary embodiments (with reference to the attached drawings).

DESCRIPTION OF THE EMBODIMENTS

An exemplary embodiment of the present invention will now be described in detail in accordance with the accompanying drawings. A printing apparatus using an inkjet printing method will be exemplified. The printing apparatus may be a single-function printer having only the printing function, or a multi-function printer having a plurality of functions such as the printing function, FAX function, and scanning function. The printing apparatus may be a manufacturing apparatus for manufacturing a color filter, electric device, optical device, micro structure, or the like by a predetermined printing method.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, the term "printing element" (to be also referred to as a "nozzle") generically means an ink orifice, a fluid channel communicating with it, and an element which generates energy to be used to discharge ink, unless otherwise specified.

(Common Embodiment)

Figure 1:
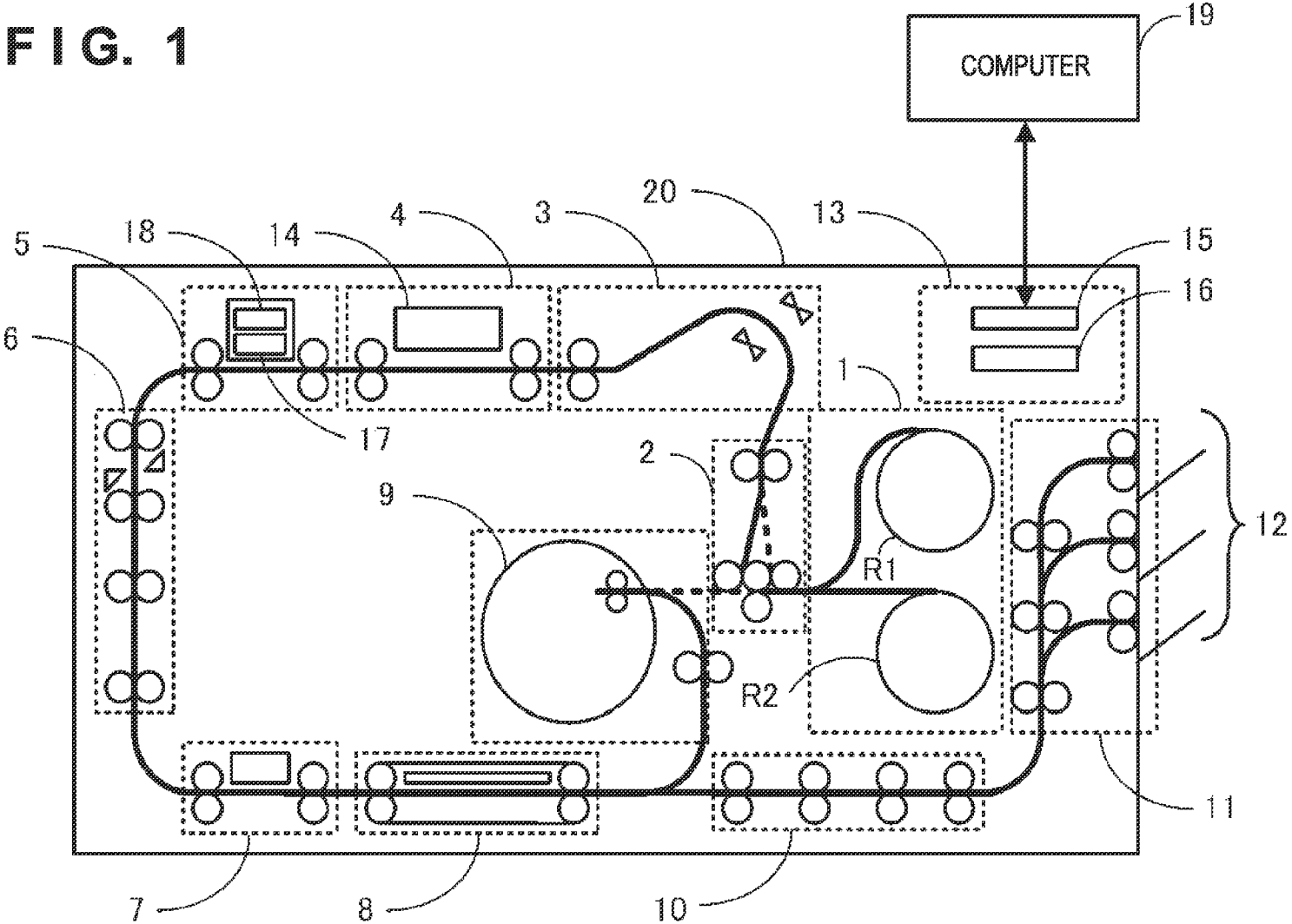
FIG. 1 is a view exemplifying a printing system configured by arranging a printing apparatus 20 according to an embodiment of the present invention.

An apparatus arrangement common to several embodiments to be described later will be explained. FIG. 1 is a view exemplifying a printing system configured by arranging a printing apparatus of an inkjet method (to be simply referred to as a printing apparatus hereinafter) according to the common embodiment of the present invention. In the embodiment, a printing medium is a rolled continuous sheet, and the printing apparatus copes with both single-sided printing and double-sided printing. This printing apparatus is suitable when, for example, a large number of sheets are printed.

The printing system includes a personal computer (to be simply referred to as a computer hereinafter) 19, and a printing apparatus 20.

The computer 19 has a function of supplying image data. The computer 19 includes a main control unit such as a CPU, a ROM (Read Only Memory), a RAM (Random Access Memory), and a storage unit such as an HDD (Hard Disk Drive). The computer 19 may include an input/output unit such as a keyboard and mouse, and a communication unit such as a network-card. These building units are connected by a bus or the like, and controlled by executing a program stored in the store unit by the main control unit.

The printing apparatus 20 prints an image on a printing medium based on image data sent from the computer 19. In the embodiment, the printing apparatus 20 employs the inkjet method, and can print on a rolled printing medium (continuous sheet). The printing apparatus 20 incorporates a sheet supply unit 1, decurl unit 2, skew correction unit 3, printing unit 4, inspection unit 5, cutout unit 6, information printing unit 7, drying unit 8, sheet take-up unit 9, and conveying unit 10. In addition, the printing apparatus 20 incorporates a sorter unit 11, document output trays 12, a control unit 13, and a cleaning unit (to be described later). A conveyance mechanism including a roller pair and belt conveys a printing medium (continuous sheet) along a conveyance path (indicated by a thick line in FIG. 1). On the conveyance path, the building units of the printing apparatus 20 perform various processes for the sheet. The sheet supply unit 1 continuously supplies a sheet. The sheet supply unit 1 can store two rolls R1 and R2. The sheet supply unit 1 pulls out and supplies a sheet from one roll. Note that the number of storable rolls is not always two, and the sheet supply unit 1 may be configured to be able to store one or three or more rolls.

The decurl unit 2 reduces a curl of a sheet supplied from the sheet supply unit 1. The decurl unit 2 decurls the sheet to give an opposite curl using two pinch rollers for one driving roller, thereby reducing the curl of the sheet.

The skew correction unit 3 corrects a skew of the sheet having passed through the decurl unit 2 in the traveling direction. The skew correction unit 3 corrects a skew of the sheet by pressing the reference side of the sheet against a guide member.

The printing unit 4 prints an image on the conveyed sheet. The printing unit 4 includes a plurality of conveyance rollers for conveying a sheet, and a plurality of inkjet printheads (to be simply referred to as printheads hereinafter) 14. Each printhead 14 is formed from a full-line type printhead, and has a printing width corresponding to the maximum width of a sheet assumed to be used.

The plurality of printheads 14 are aligned in the sheet conveyance direction. The printing unit 4 in the embodiment includes four printheads corresponding to four, K (blacK), C (Cyan), M (Magenta), and Y (Yellow). The printheads are aligned in the order of K, C, M, and Y from the upstream side in the sheet conveyance direction. The respective printheads are arranged with the same printing width in the sheet conveyance direction. The number of colors and that of printheads need not always be four, and can be changed properly. The inkjet method can be a method using an electro-thermal transducer, a method using a piezoelectric element, a method using an electrostatic element, or a method using a MEMS element. Inks of the respective colors are supplied from ink tanks to the printheads 14 via ink tubes.

The inspection unit 5 optically reads a pattern or image printed on a sheet, and inspects the nozzle state of the printhead 14, the conveyance state of a sheet, the image position, and the like. The inspection unit 5 includes a scanner 17 which reads an image, and an image analyzing unit 18 which analyzes the read image and transmits the analysis result to a controller unit 15.

The scanner 17 is formed from, for example, a CCD line sensor arranged in a direction perpendicular to the sheet conveyance direction. The CCD line sensor is formed from, for example, a two-dimensional image sensor in which a plurality of CCD elements each used as a reading element are aligned in a direction (nozzle arrayed direction) perpendicular to the sheet conveyance direction. Note that the scanner 17 need not always be formed from a CCD line sensor, and may be formed from a sensor of another method. The image analyzing unit 18 includes, for example, a CPU which analyzes the read image. The cutout unit 6 cuts a sheet into a predetermined length. The cutout unit 6 includes a plurality of conveyance rollers for supplying a sheet to the next process. The information printing unit 7 prints information such as a serial number and date on the reverse surface of a sheet.

The drying unit 8 heats a sheet to dry ink on the sheet within a short time. The drying unit 8 includes a conveyance belt and conveyance roller for supplying a sheet to the next process.

In double-sided printing, the sheet take-up unit 9 temporarily takes up a sheet having undergone printing on its obverse surface. The sheet take-up unit 9 includes a take-up drum which rotates to take up a sheet. After the end of printing on the obverse surface of a sheet, the sheet which has not been cut by the cutout unit 6 is temporarily taken up by the take-up drum. After the end of take-up, the take-up drum rotates reversely, and the taken-up sheet is conveyed to the printing unit 4 via the decurl unit 2. The conveyed sheet has been turned over, so the printing unit 4 can print on the reverse surface of the sheet. A detailed operation in double-sided printing will be described later.

The conveying unit 10 conveys a sheet to the sorter unit 11. If necessary, the sorter unit 11 sorts and discharges sheets to the different document output trays 12. The control unit 13 controls the respective units of the printing apparatus 20. The control unit 13 includes the main control unit 15 including a CPU, memories (ROM and ROM), and various I/O interfaces, and a power supply unit 16.

The sequence of a basic operation in the printing operation will be described with reference to FIGS. 2A and 2B. The printing operation differs between single-sided printing and double-sided printing, and the respective printing operations will be explained.

Figure 2A:
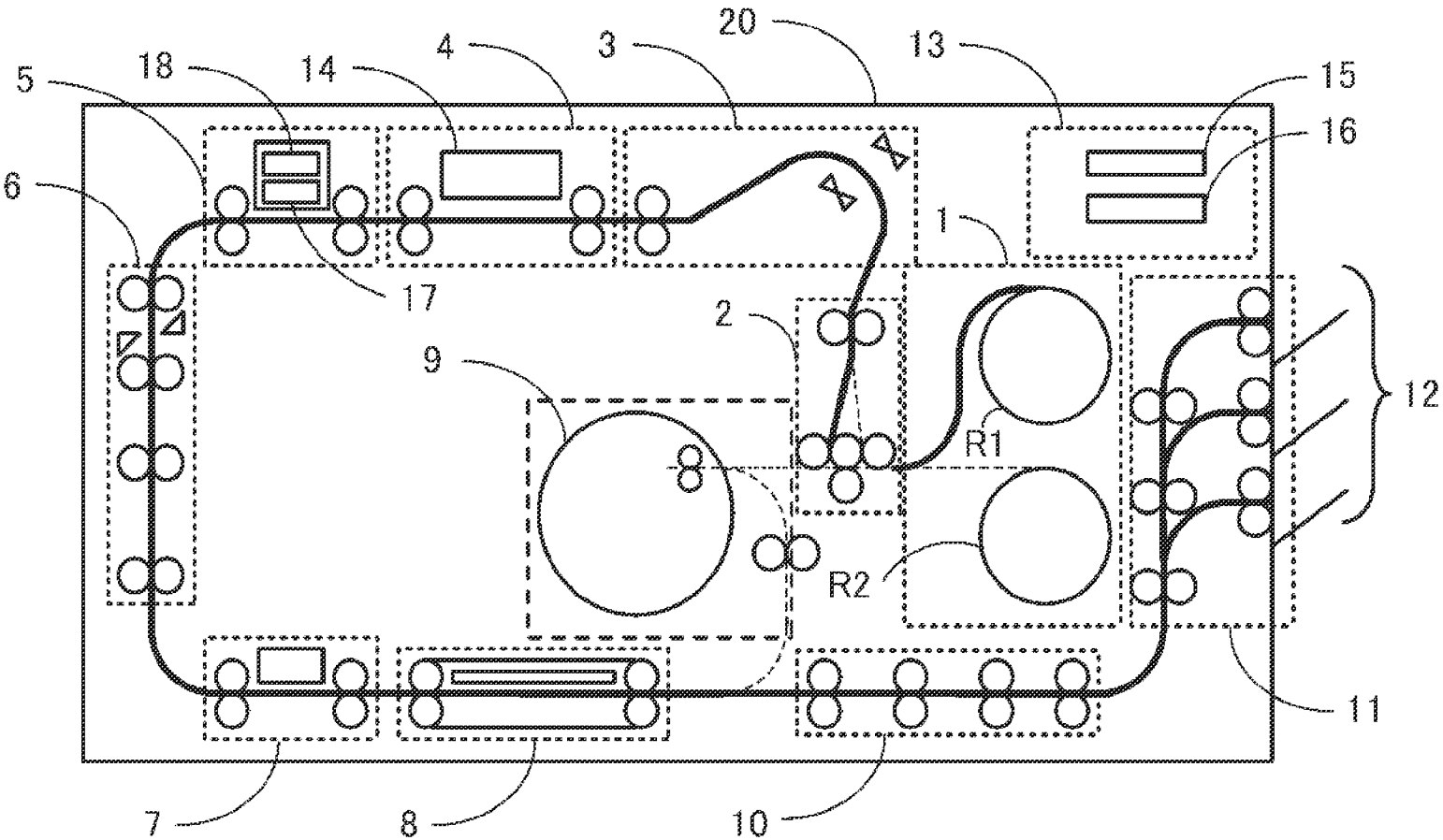
FIG. 2A is a view showing an outline of a printing operation in the printing apparatus 20.

FIG. 2A is a view for explaining an operation in single-sided printing. In FIG. 2A, a thick line indicates a conveyance path until a sheet is discharged to the document output tray 12 after an image is printed on the sheet supplied from the sheet supply unit 1.

After the sheet supply unit 1 supplies a sheet, the decurl unit 2 and skew correction unit 3 process the sheet, and the printing unit 4 prints an image on the obverse surface of the sheet. The sheet bearing the image passes through the inspection unit 5, and is cut into a predetermined length by the cutout unit 6. If necessary, the information printing unit 7 prints information such as a date on the reverse surface of the cut sheet. Thereafter, sheets are dried one by one by the drying unit 8, and discharged to the document output tray 12 in the sorter unit 11 via the conveying unit 10.

Figure 2B:
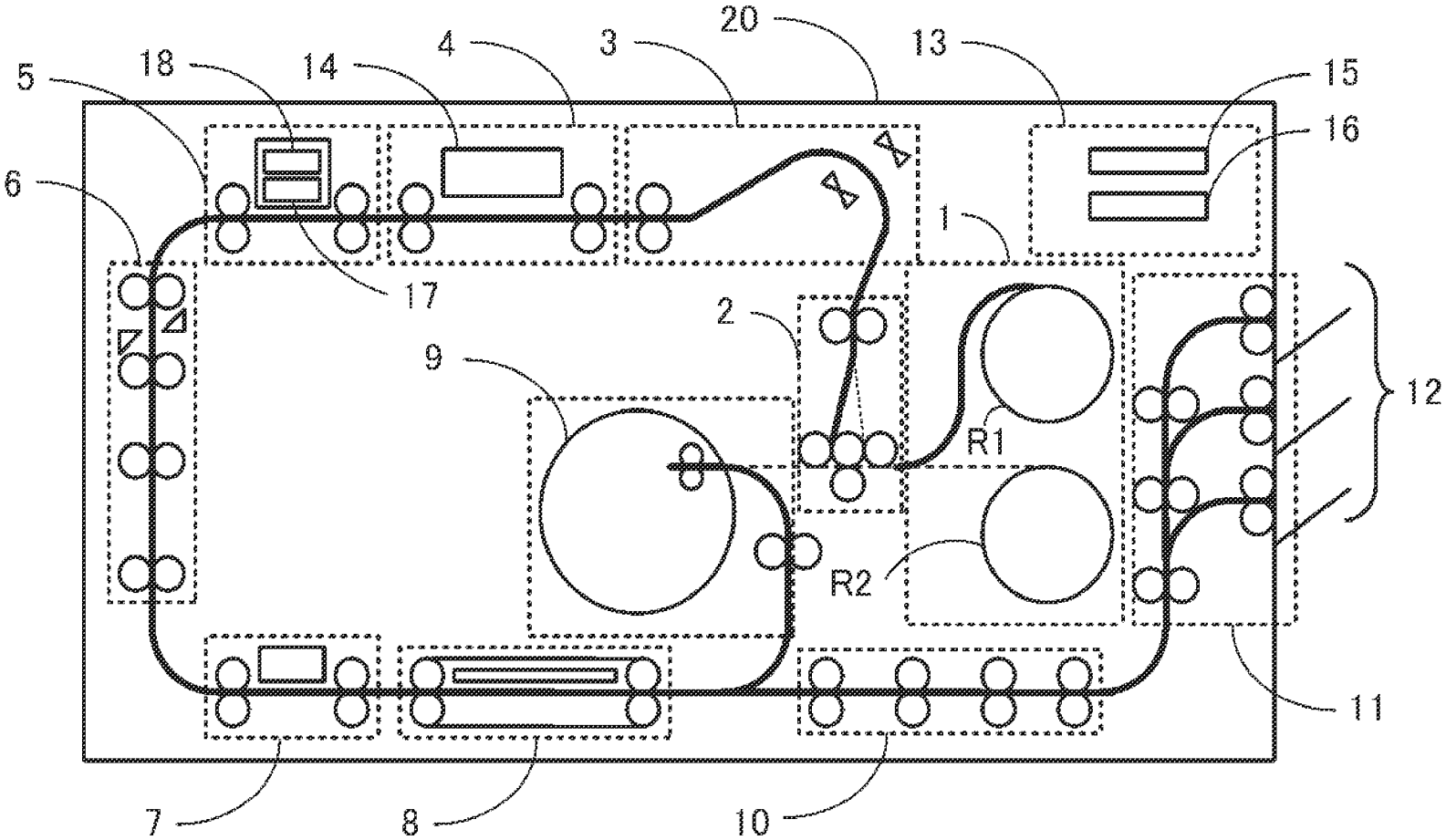
FIG. 2B is a view showing an outline of a printing operation in the printing apparatus 20.

FIG. 2B is a view for explaining an operation in double-sided printing. In double-sided printing, a printing sequence for the reverse surface of a sheet is executed subsequently to a printing sequence for the obverse surface of the sheet. In FIG. 2B, a thick line indicates a conveyance path when printing an image on the obverse surface of a sheet in double-sided printing.

The operations of the respective building units including the sheet supply unit 1 to the inspection unit 5 are the same as those in single-sided printing described with reference to FIG. 2A. The difference is processes by the cutout unit 6 and subsequent units. More specifically, when a sheet is conveyed to the cutout unit 6, the cutout unit 6 cuts the trailing edge of the printing area of the sheet, instead of cutting the sheet into a predetermined length. When the sheets is conveyed to the drying unit 8, the drying unit 8 dries ink on the obverse surface of the sheet, and the sheet is conveyed not to the conveying unit 10 but to the sheet take-up unit 9. The conveyed sheet is taken up by the take-up drum of the sheet take-up unit 9 which rotates anticlockwise in FIG. 2B. More specifically, the take-up drum takes up all the sheet up to the trailing edge. Note that a sheet on the more upstream side in the conveyance direction than the trailing edge of the sheet cut by the cutout unit 6 is wound back by the sheet supply unit 1 so that the leading edge of the sheet does not remain in the decurl unit 2.

After the end of the printing sequence for the obverse surface of the sheet, the printing sequence for the reverse surface of the sheet starts. At the start of this sequence, the take-up drum rotates clockwise in FIG. 2B reversely to take-up. The taken-up sheet is conveyed to the decurl unit 2. At this time, the trailing edge of the sheet in take-up serves as the leading edge of the sheet in conveyance from the sheet take-up unit 9 to the decurl unit 2. The decurl unit 2 corrects the curl of the sheet reversely to printing of an image on the obverse surface of the sheet. This is because the sheet is wound around the take-up drum so that its obverse and reverse surfaces are turned over from the roll in the sheet supply unit 1, and the sheet has a reverse curl.

After passing through the skew correction unit 3, the sheet is conveyed to the printing unit 4, where an image is printed on the reverse surface of the sheet. After passing through the inspection unit 5, the sheet bearing the image is cut into a predetermined length by the cutout unit 6. Since images are printed on the two surfaces of the cut sheet, the information printing unit 7 does not print information such as a date. The sheet is then discharged to the document output tray 12 of the sorter unit 11 via the drying unit 8 and conveying unit 10.

Figure 3:
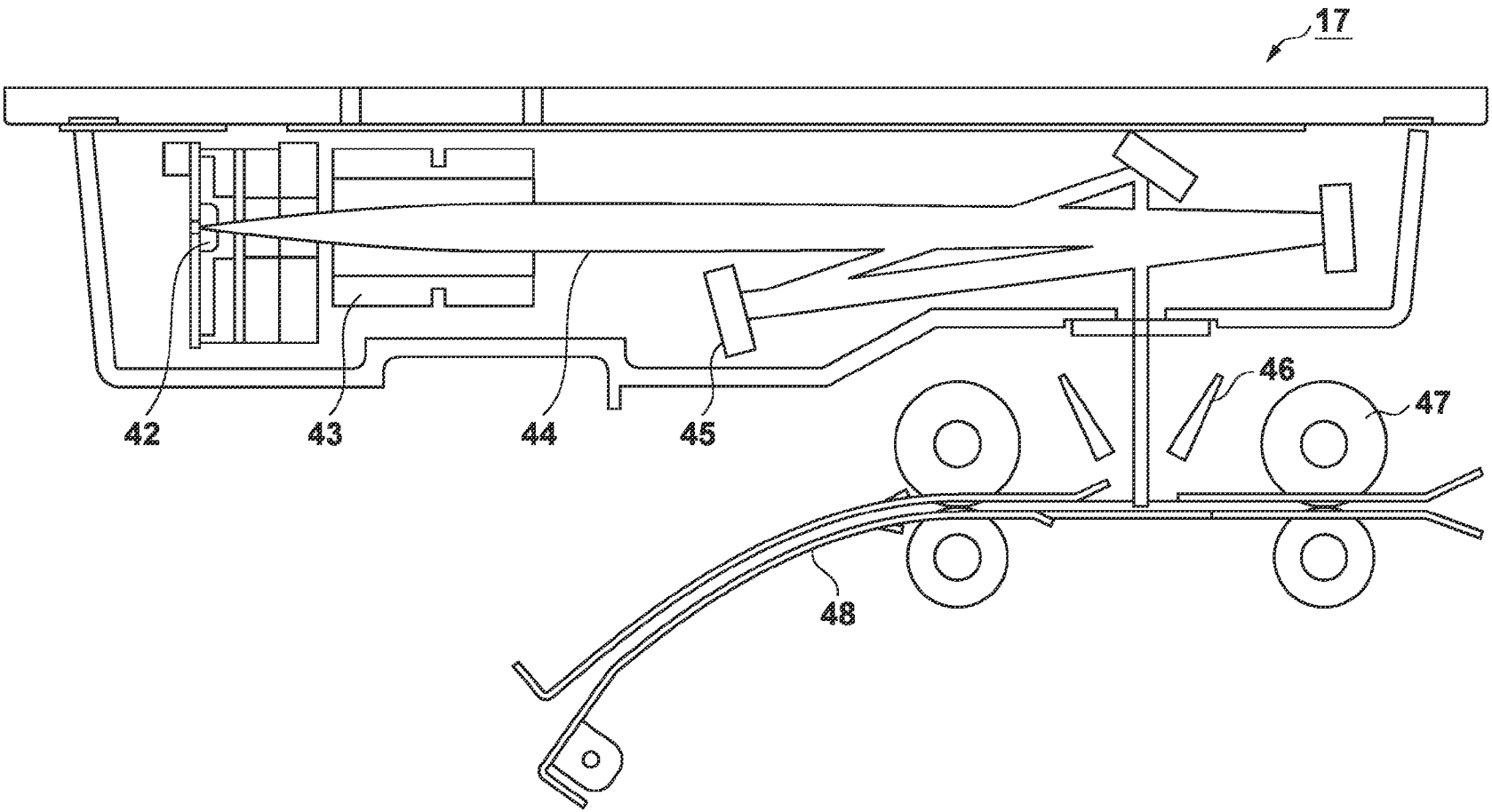
FIG. 3 is a view exemplifying the arrangement of a scanner 17.

The arrangement of the scanner 17 shown in FIG. 1 will be described with reference to FIG. 3. The scanner 17 includes a CCD line sensor 42, lens 43, mirror 45, illumination unit 46, conveyance roller 47, and conveyance guide member 48.

The illumination unit 46 emits light toward a sheet. The CCD line sensor 42 converts received light into an electrical signal. The light emitted by the illumination unit 46 toward the sheet is reflected by the sheet, and enters the CCD line sensor 42 via the mirror 45 and lens 43 (optical path 44). Image data converted into an electrical signal by the CCD line sensor 42 is input to the image analyzing unit 18 and analyzed. The conveyance roller 47 conveys the sheet, and the conveyance guide member 48 is a supporting member for guiding a sheet. The conveyance roller 47 conveys, at a predetermined speed, the sheet guided by the conveyance guide member 48. In this example, the layout distance (highest resolution of reading) of the CCD line sensor 42 of the scanner 17 according to the embodiment is 1,200 dpi, which is equal to a resolution determined by the nozzle array. When scanning an image at a resolution lower than the layout distance of the CCD line sensor 42, image data is generated by adding outputs from a plurality of CCD line sensors 42 corresponding to the resolution. However, the present invention is not limited to this example. For example, the resolution of the scanner 17 may be ⅓ (400 dpi) of the resolution determined by the nozzle array.

Figure 4:
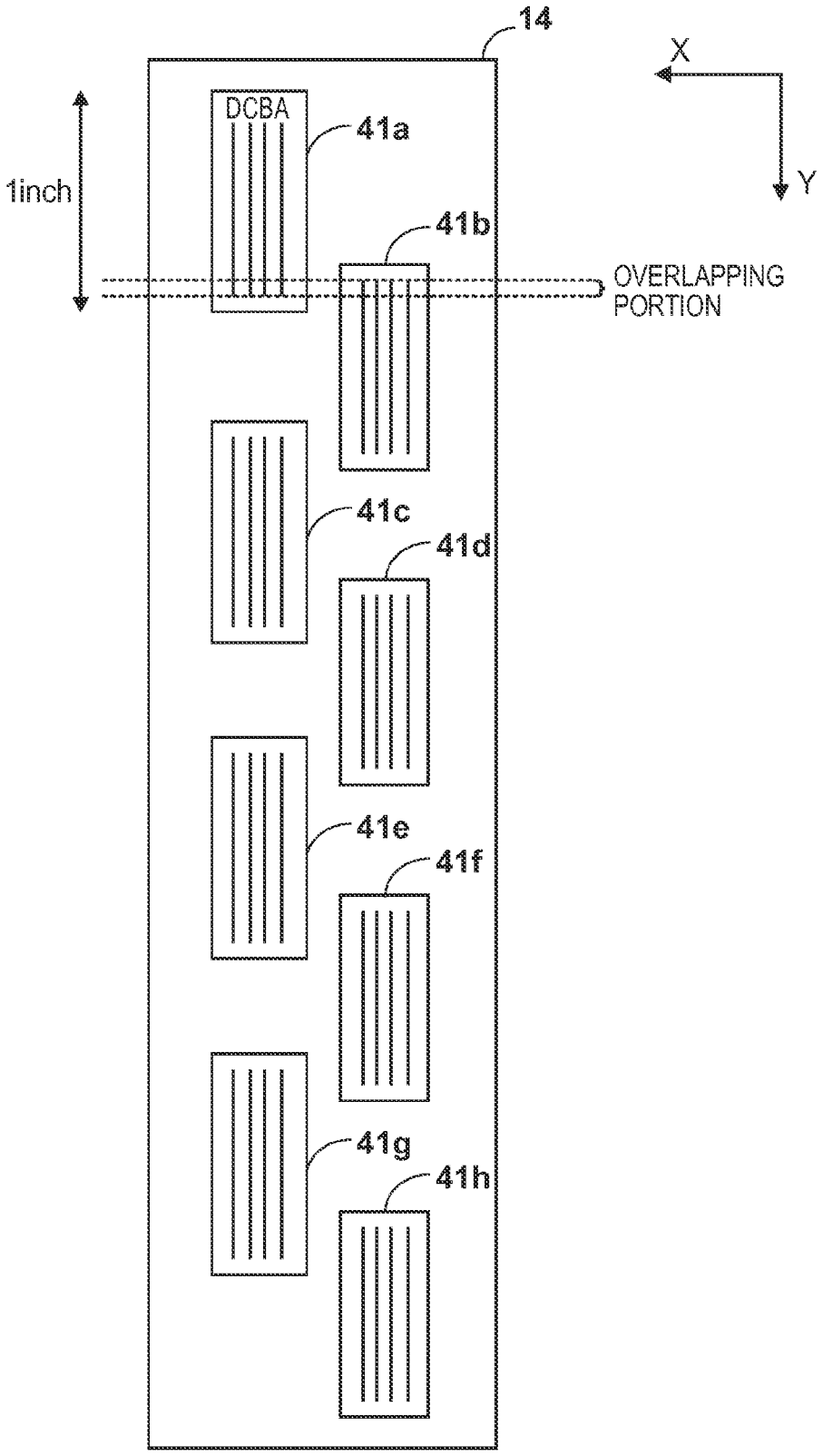
FIG. 4 is a view exemplifying the arrangement of a printhead 14.

Next, the arrangement of the printhead 14 shown in FIG. 1 will be exemplified with reference to FIG. 4. The plurality of printheads 14 include four printheads 14 corresponding to four, K (black), C (Cyan), M (Magenta), and Y (Yellow). The respective printheads have the same arrangement, and one of the printheads will be exemplified. In this case, the sheet conveyance direction is defined as the X direction, and a direction perpendicular to the sheet conveyance direction is defined as the Y direction.

The definitions of the X and Y directions also apply to subsequent drawings.

On the printhead 14, eight printing chips 41, that is, 41*a* to 41*h* each having an effective discharge width of about 1 inch and made of silicon are arranged to be staggered on a base board (supporting member). On each printing chip 41, a plurality of nozzle arrays are arranged. More specifically, four nozzle arrays A, B, C, and D are arranged parallelly. The printing chips 41 overlap each other by a predetermined number of nozzles. More specifically, some nozzles of nozzle arrays on printing chips adjacent to each other overlap each other in the Y direction.

Each printing chip 41 includes a temperature sensor (not shown) which measures the temperature of the printing chip. A printing element (heater) formed from, for example, a heat generation element is arranged in the discharge orifice of each nozzle. The printing element can bubble a liquid by heating it, and discharge it from the discharge orifice of the nozzle by the kinetic energy. The printhead 14 has an effective discharge width of about 8 inches, and the length of the printhead 14 in the Y direction substantially coincides with that of an A4 printing sheet in the shorter side direction. That is, the printhead 14 can complete printing of an image by one scan.

(Cleaning Unit)

Figure 5A:
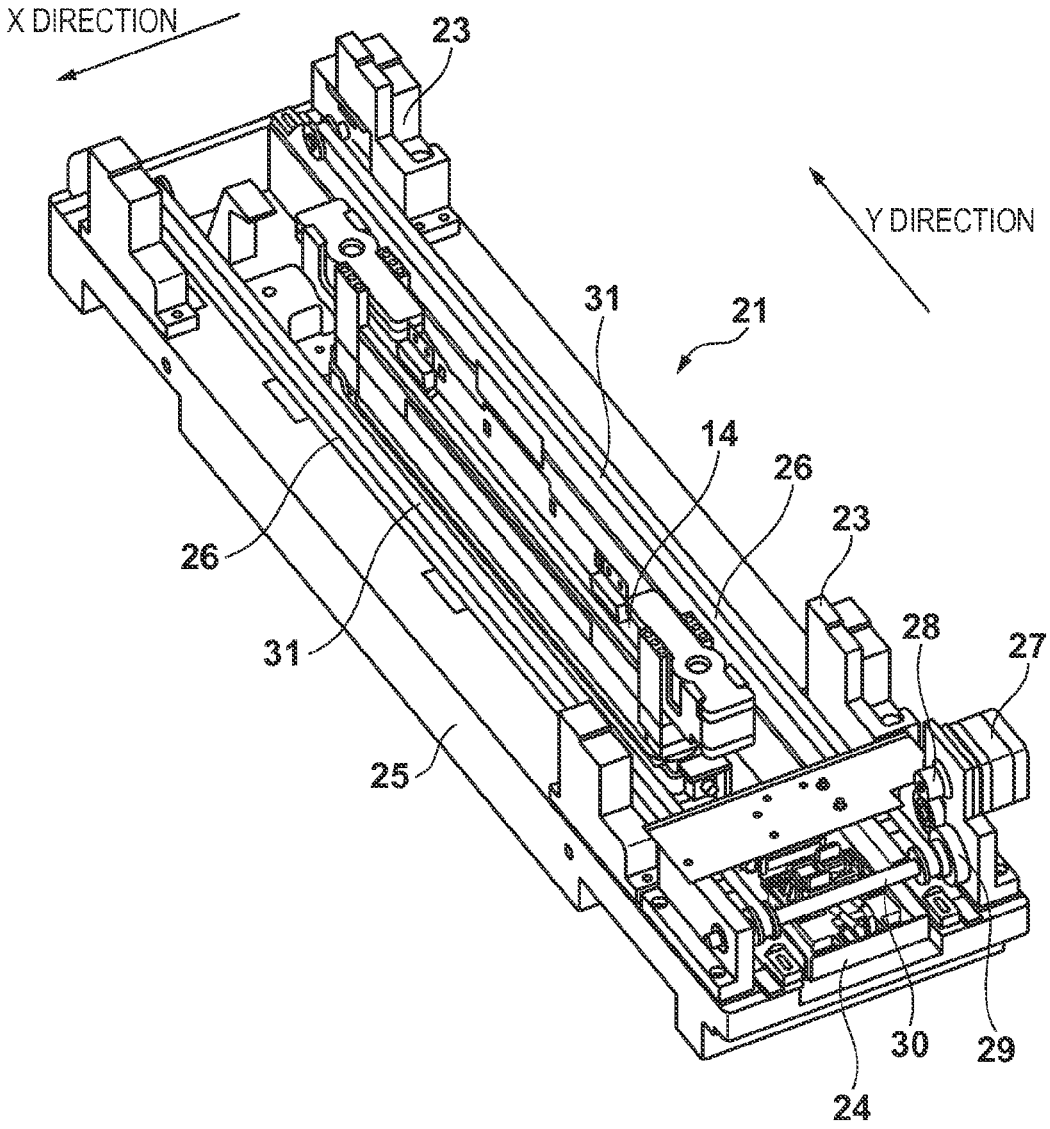
FIGS. 5A and 5B are perspective views showing the arrangement of a cleaning mechanism.
Figure 5B:
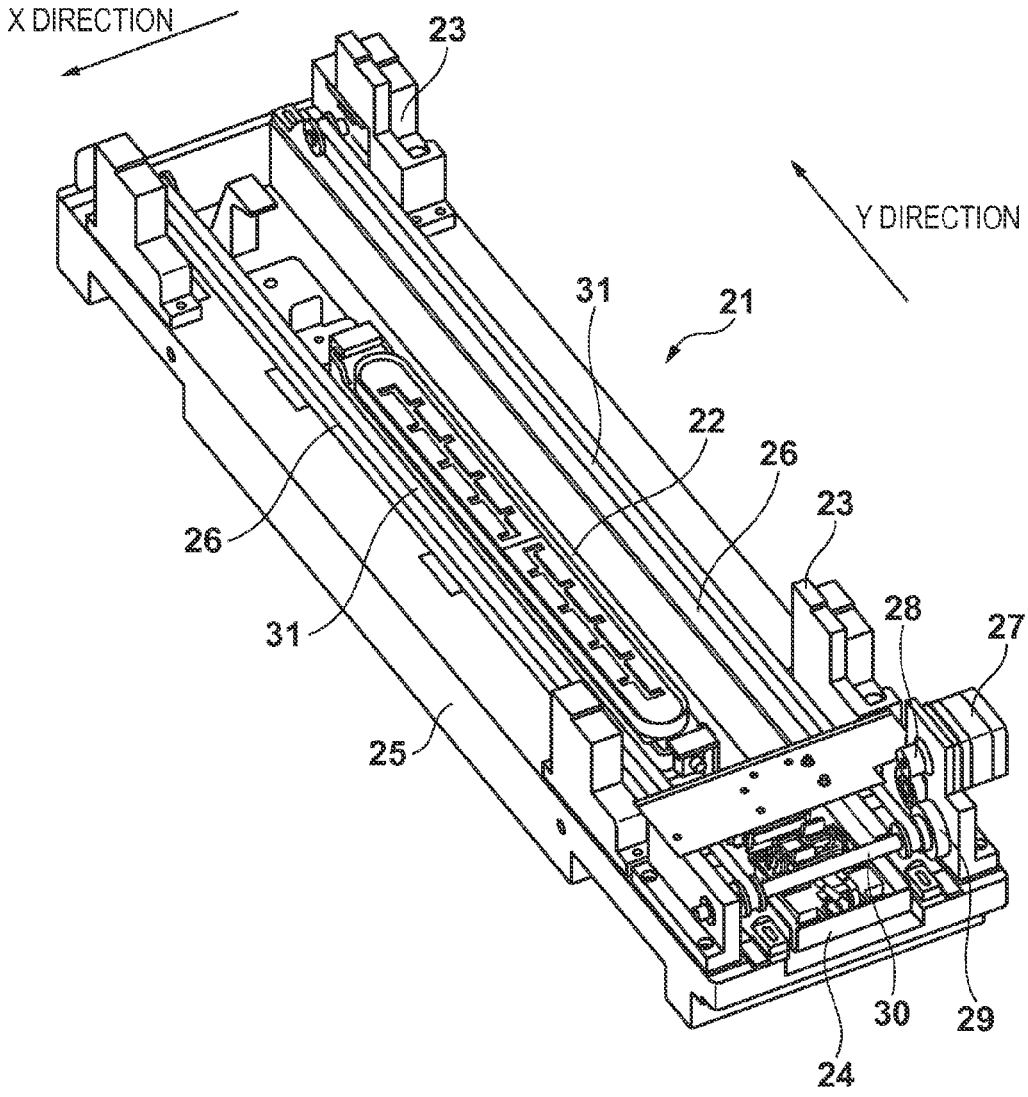

The cleaning unit used to clean the nozzle surface of the printhead 14 will be described. FIGS. 5A and 5B are perspective views showing the detailed arrangement of one cleaning mechanism 21 included in the cleaning unit. The cleaning unit includes a plurality of (four) cleaning mechanisms 21 corresponding to the plurality of (four) printheads 14. FIG. 5A shows a state (in the cleaning operation) in which the printhead 14 exists on the cleaning mechanism 21. FIG. 5B shows a state in which no printhead exists on the cleaning mechanism 21.

The cleaning unit includes the cleaning mechanism 21, a cap 22, and a positioning member 23. The cleaning mechanism 21 includes a wiper unit 24 which removes a deposit to the discharge orifice of the nozzle of the printhead 14, a moving mechanism which moves the wiper unit 24 in the Y direction, and a frame 25 which integrally supports them. A driving source drives the moving mechanism to move, in the Y direction, the wiper unit 24 guided by two guide shafts 26. The driving source includes a driving motor 27, and gears 28 and 29, and rotates a driving shaft 30. The rotation of the driving shaft 30 is transmitted by a belt 31 and a pulley to move the wiper unit 24.

Figure 6:
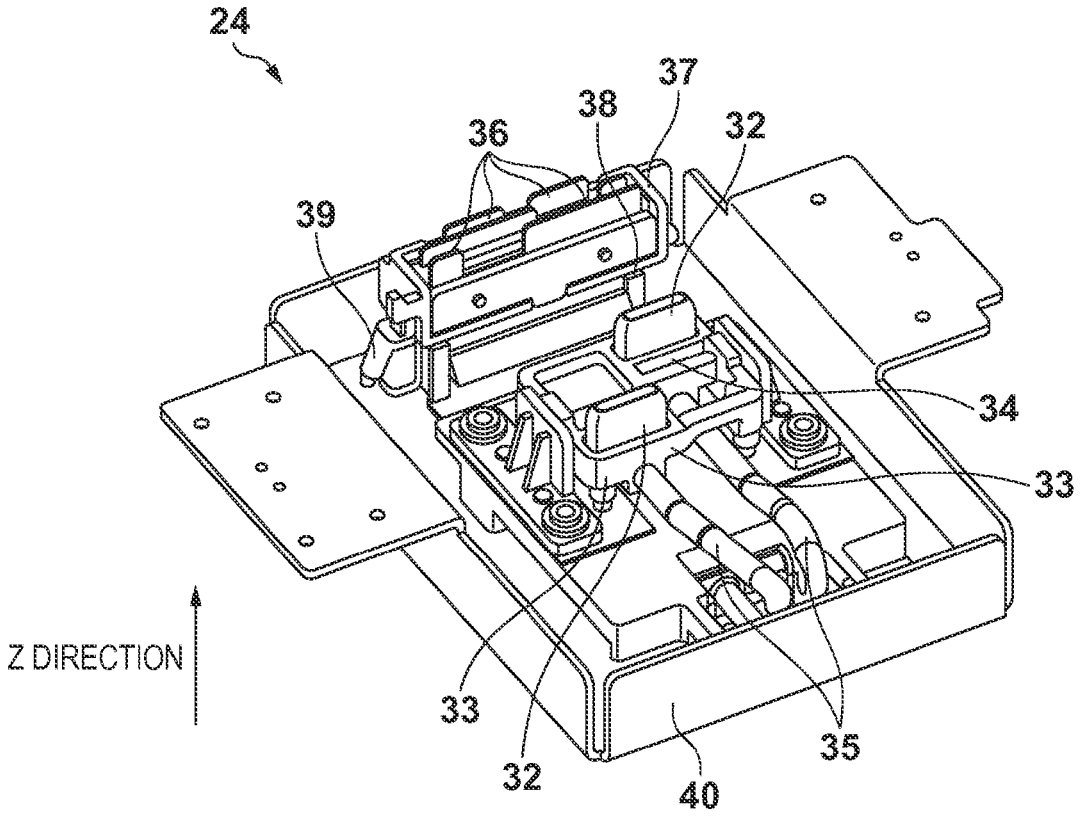
FIG. 6 is a view showing the arrangement of a wiper unit.

FIG. 6 is a view showing the arrangement of the wiper unit 24. The wiper unit 24 includes two suction orifices 32 in correspondence with the two arrays of the printing chips 41 in the Y direction. The two suction orifices 32 have the same interval as that between the two arrays of the printing chips 41 in the X direction. The two suction orifices 32 have almost the same shift amount as the shift amount between the two arrays of the printing chips 41 in the Y direction. The suction orifices 32 are held by a suction holder 33, and the suction holder 33 can move in the Z direction by an elastic member 34.

Tubes 35 are connected to the two suction orifices 32 via the suction holder 33, and a negative pressure generation unit such as a suction pump is connected to the tubes 35. When the negative pressure generation unit operates, the suction orifices 32 suck ink and dust. In this way, ink and dust are sucked from the discharge orifices of the nozzles of the printhead 14. A blade holder 37 holds two blades 36 on each of the right and left sides, that is, a total of four blades. The blade holder 37 is supported at two ends in the X direction, and can rotate about a rotation axis in the X direction. The blade holder 37 is generally movable by an elastic member 39 up to a stopper 38. The blade 36 can change the orientation of the blade surface between a wiping position and an evacuation position in accordance with the operation of a switching mechanism. The suction holder 33 and blade holder 37 are set on a common support member 40 of the wiper unit 24.

By cleaning the nozzles of the printhead 14 by the cleaning unit, even if a discharge failure nozzle is generated owing to attachment of dust such as paper dust or mote near a nozzle, attachment of an ink mist, an increase in ink viscosity, mixing of bubbles or dust into ink, or the like, it can be recovered.

(First Embodiment)

A non-discharge detection operation in the first embodiment will be described. The non-discharge detection operation is an operation of detecting a discharge failure nozzle generated upon attachment of dust such as paper dust or mote near a nozzle, attachment of an ink mist, an increase in ink viscosity, mixing of bubbles or dust into ink, or the like.

Figure 7:
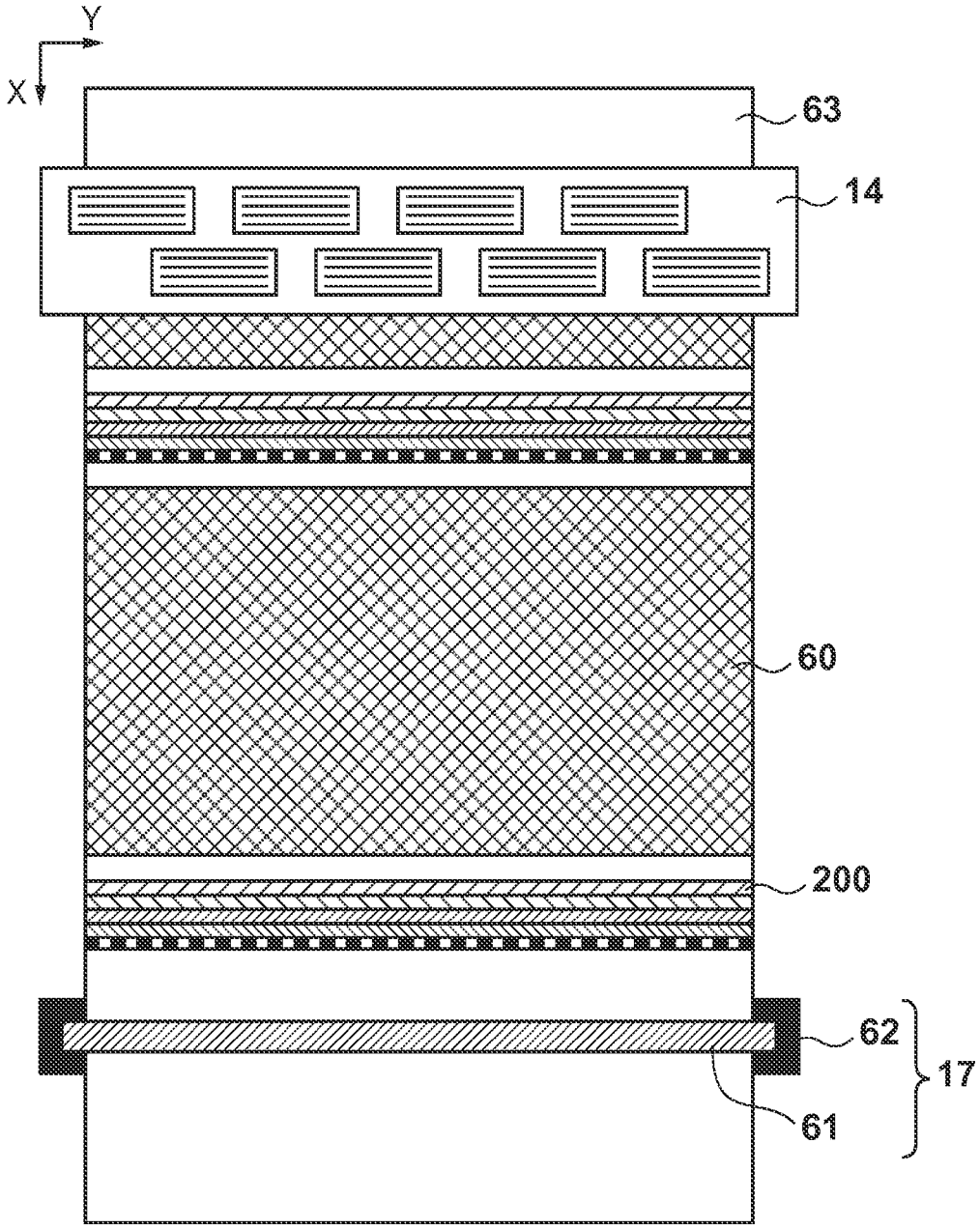
FIG. 7 is a view for explaining an outline of a non-discharge detection operation in the first embodiment.

FIG. 7 is a schematic view showing the positional relationship between a printhead 14, a scanner 17, an image 60, and an inspection pattern 200 according to the first embodiment.

A sheet 63 is conveyed from the upstream side to the downstream side in the X direction on the sheet surface of FIG. 7. The printhead 14 prints the image 60 and inspection pattern 200 during one sheet conveyance. The inspection pattern 200 is a pattern for inspecting the discharge failure of a nozzle. Note that the printing frequency of the inspection pattern 200 can be set arbitrarily. In this case, the inspection pattern 200 is inserted every time an image is printed. In the following description, a black (K) printhead will be exemplified for descriptive convenience. However, the same processing applies to printheads of the remaining colors.

A region 61 is a region where a CCD line sensor 42 of the scanner 17 can read an image. The width of the region 61 in the Y direction is set to be larger than the printing width of the inspection pattern 200 in the Y direction.

A background 62 is arranged below a printing medium at a position facing the scanner 17. The entire surface of the background 62 is coated in black to reduce the influence of reflection of light by the background on the scan result. The inspection pattern 200 is read while it passes through the readable region 61 of the scanner 17. The reading result is transferred to an image analyzing unit 18 to perform analysis regarding a discharge failure nozzle.

Figure 8:
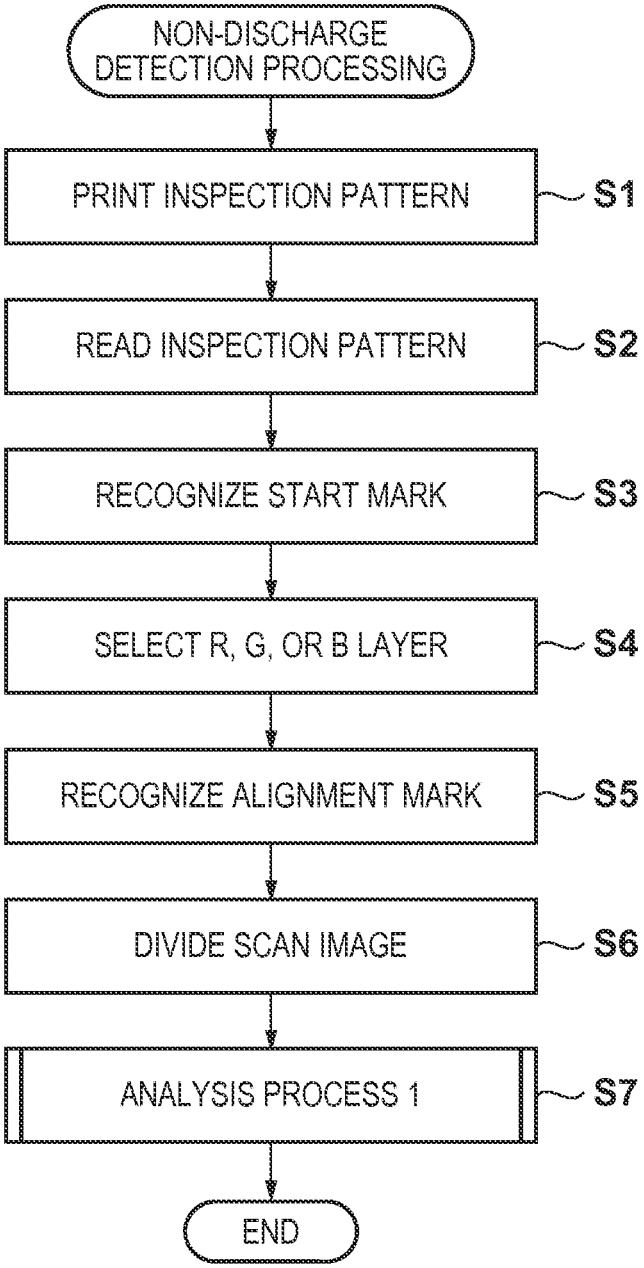
FIG. 8 is a flowchart for explaining non-discharge detection processing in the first embodiment.

Processing in a non-discharge detection operation will be explained with reference to the flowchart of FIG. 8.

Figure 9:
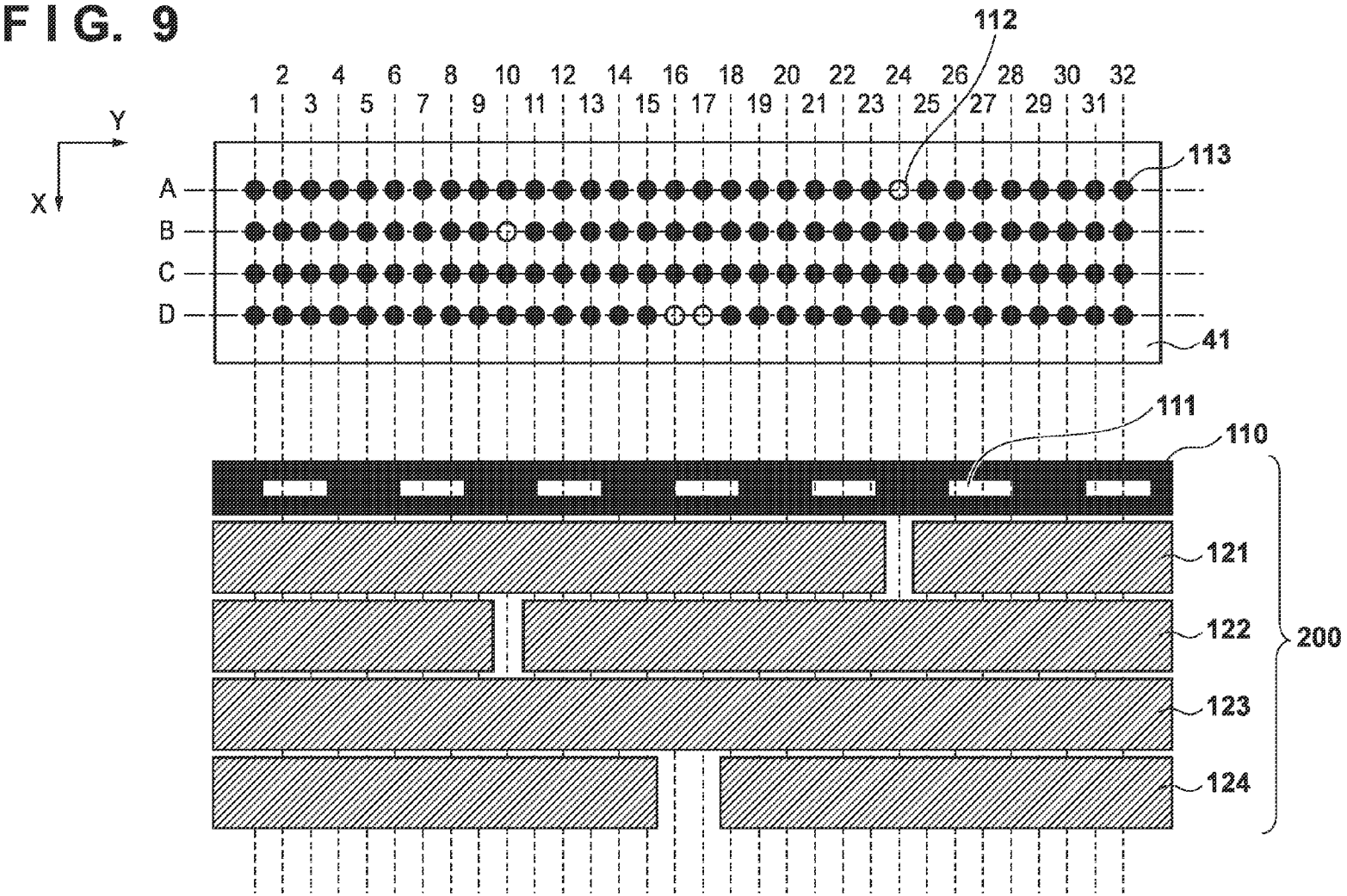
FIG. 9 is a view showing the relationship between the printhead and a non-discharge detection pattern when a discharge failure occurs in the first embodiment.

In step S1, the inspection pattern 200 is printed between images using all nozzles of each color. For descriptive convenience, an inspection pattern of one ink color (Bk) will be explained. FIG. 9 is a view showing the relationship between the printhead 14 and the inspection pattern 200. FIG. 9 exemplifies an inspection pattern printed by the nozzles of one printing chip out of a plurality of printing chips 41 on the printhead 14. The printing chip 41 has a resolution of 1,200 dpi in the Y direction, and is formed from four arrays A to D in the X direction.

The inspection pattern 200 is formed from a start mark 110, alignment mark 111, array A inspection pattern 121, array B inspection pattern 122, array C inspection pattern 123, and array D inspection pattern 124. The start mark 110 is used to specify the start position of the inspection pattern 200 in analysis of a discharge failure nozzle, and is also used for preliminary discharge of each nozzle array. The alignment mark 111 is a blank portion, and is used to specify the coarse position of a discharge failure nozzle. Note that the start mark 110 is printed using all nozzle arrays so that it is hardly affected even if a discharge failure nozzle exists.

As a numeral representing the number of discharges per unit time from one nozzle, printing of one dot at every 1,200 dpi in normal image printing will be defined as a nozzle duty of 50%. In this case, the start mark 110 is printed by 10 dots per nozzle at a nozzle duty of 20% for a most frequently used nozzle. That is, a total of about 40 dots are printed by the four nozzle arrays at a nozzle duty of about 80%.

The array A inspection pattern 121 to array D inspection pattern 124 are uniform-density patterns formed by shifting the positions of 24 dots per nozzle in the X direction at 1,200 dpi. The number of discharges per unit time for the uniform-density pattern is a nozzle duty of 50% in nozzle duty conversion described above. The maximum nozzle duty when printing an image is 30%. For the array A inspection pattern to array D inspection pattern, the number of discharges per unit time from one nozzle is set larger than that in image printing.

In FIG. 9, an open circle 112 represents a discharge failure nozzle, and a filled circle 113 represents a discharge nozzle. In FIG. 9, the 24th nozzle of array A, the 10th nozzle of array B, and the 16th and 17th nozzles of array D are discharge failure nozzles. At this time, no ink is discharged to portions which should be printed by the discharge failure nozzles, and these portions appear as blank regions in the inspection pattern 200. Even when the ink-landing position shift of an ink droplet occurs other than a discharge failure, a blank region similarly appears in the inspection pattern 200. When the ink-landing position shift amount exceeds a predetermined value, the ink-landing position shift can be handled similarly to a discharge failure.

In step S2, the image analyzing unit 18 controls the scanner 17 to read the inspection pattern 200 printed between images while the printing medium is kept conveyed. In the first embodiment, the reading resolution of the scanner 17 is set by selecting it from a plurality of different modes. In step S2, the reading resolution is set to 400 dpi, and reading is performed.

The image analyzing unit 18 recognizes the read start mark 110 in step S3, and selects an R, G, or B layer for performing analysis for each ink type in step S4. More specifically, analysis is performed using the G (Green) layer for the Bk and M inspection patterns, the R (Red) layer for the C inspection pattern, and the B (Blue) layer for the Y inspection pattern.

In step S5, the image analyzing unit 18 recognizes the alignment mark 111, and specifies the coarse position of a nozzle for scan data. In step S6, the image analyzing unit 18 divides the scan data for the respective ink colors or nozzle arrays.

Finally, in step S7, the image analyzing unit 18 performs analysis process 1 for the divided scan data of each ink color or nozzle array that corresponds to the inspection pattern 200. By this process, a nozzle in which a discharge failure, print position shift, or the like has occurred is specified. Then, the non-discharge detection operation ends.

Figure 10:
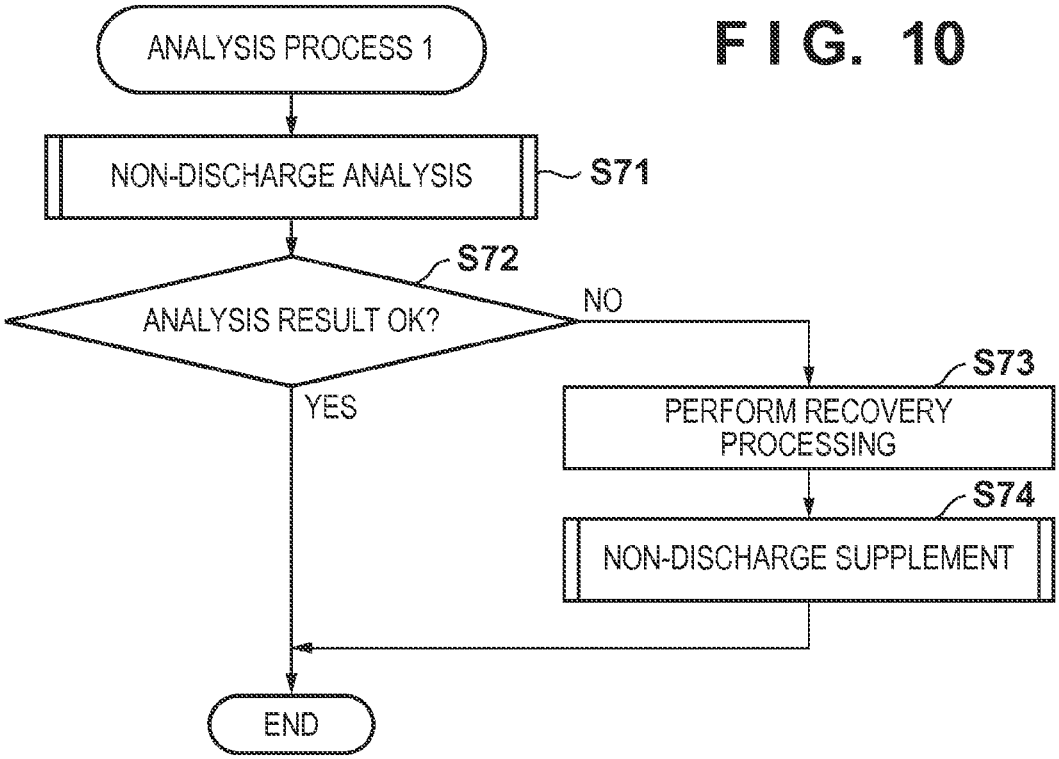
FIG. 10 is a flowchart showing processing after the non-discharge detection operation in the first embodiment.

Processing after performing the non-discharge detection operation will be described with reference to the flowchart of FIG. 10. In step S71, the image analyzing unit 18 performs, as the analysis process, analysis for detecting an ink discharge failure or ink-landing position shift. In step S72, the image analyzing unit 18 determines, based on the analysis result, whether to continuously perform the printing operation. If the image analyzing unit 18 determines to continuously perform the printing operation (analysis result is OK), the printing operation continues without performing any processing. If the image analyzing unit 18 determines not to continuously perform the printing operation (analysis result is NG), printing is interrupted, and the process advances to step S73 to perform recovery processing. In recovery processing, the face is wiped using the cleaning unit while the negative pressure generation unit acts on the nozzle to apply a negative pressure in a suction orifice 32 (suction wiping). As a result, ink and dust attached near a nozzle can be removed at high probability. As recovery processing, suction wiping has been exemplified. However, another operation such as blade wiping, suction recovery, or nozzle pressurization other than suction wiping may be performed.

Even if this recovery processing is executed, the cause of a discharge failure may not be removed. If the discharge failure remains even after recovery processing, non-discharge supplement is executed to print using a nozzle other than the discharge failure nozzle (step S74). Note that the cause of a discharge failure may not be removed by recovery processing or the position of dust may move upon recovery processing to generate a discharge failure in another nozzle. Hence, non-discharge supplement may be executed immediately without performing recovery processing.

Non-discharge supplement is executed by assigning print data of a nozzle determined to be a discharge failure nozzle, to a nozzle determined not to be a discharge failure nozzle. The printing chip 41 in the embodiment has four nozzle arrays per color. Even if a discharge failure occurs in a nozzle of one array, effective nozzles of the three remaining arrays exist and can supplement the discharge failure nozzle. As a detailed supplement method, a method as disclosed in Japanese Patent Laid-Open No. 2009-6560 is available.

The analysis performed in step S71 of FIG. 10 will be described with reference to the flowchart of FIG. 11. In step S101, the image analyzing unit 18 performs an averaging process in the sheet conveyance direction for scan data acquired from the inspection pattern 200 printed by the respective nozzle arrays for noise reduction. More specifically, for each of predetermined R, G, and B layers, averaging is performed for a plurality of luminance data which have been acquired by the scanner 17 at the position of each nozzle array that corresponds to the central region of the inspection pattern 200, and are aligned in the sheet conveyance direction. The averaged luminance value will be called a "raw value".

In step S102, the image analyzing unit 18 performs a difference calculation process to calculate the difference of a luminance value in the nozzle arrayed direction from the averaged raw value. The difference calculation process is defined as applying, to the Nth pixel:

$$\text{difference value}=\{(\text{luminance value of}(N+d)\text{th pixel})-(\text{luminance value of } N\text{th pixel})\}/2$$

d: difference calculation distance (distance for calculating a difference value)

Figure 12:
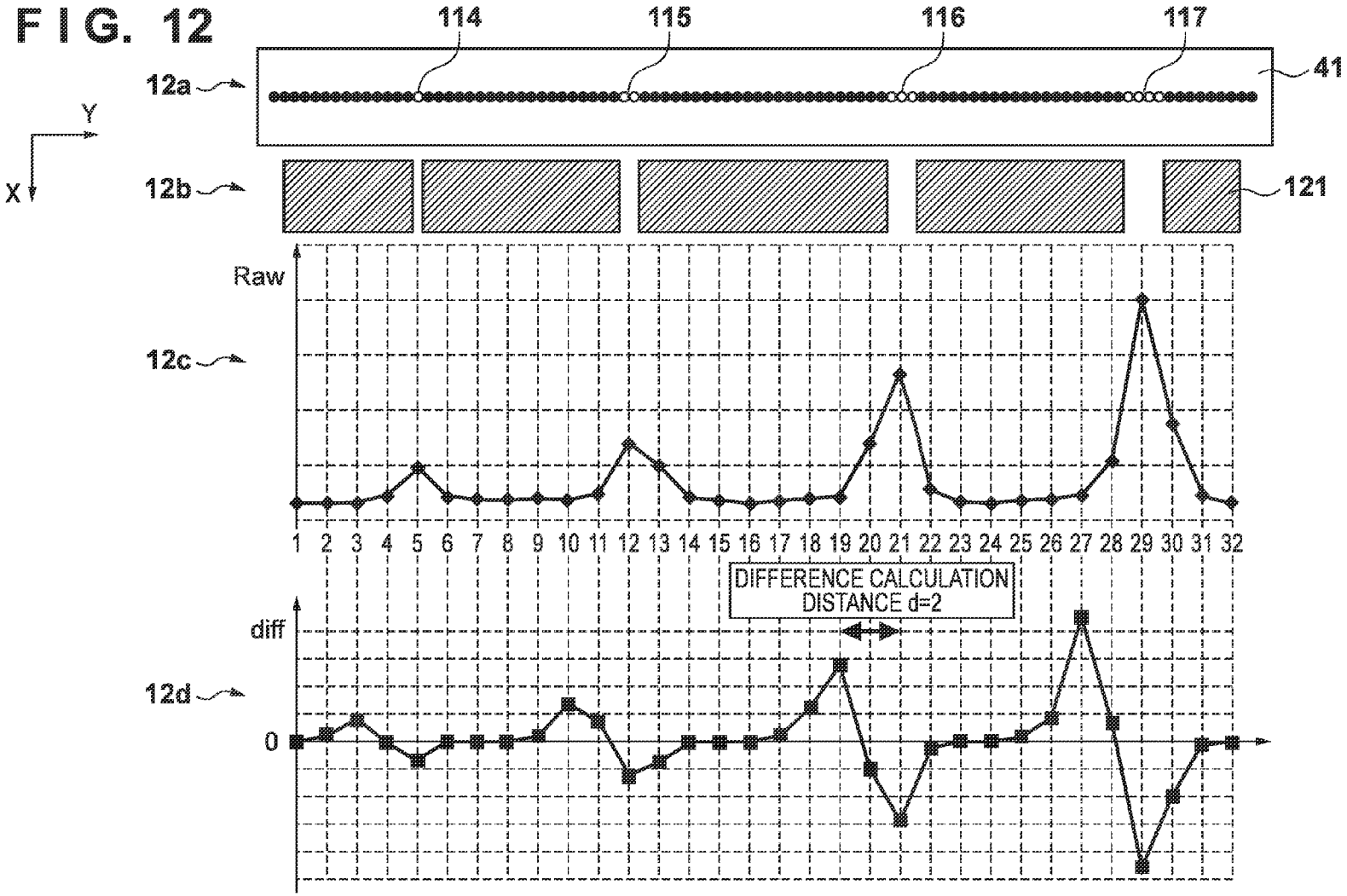
FIG. 12 is a view for explaining the relationship between the inspection pattern, the raw value, and the difference value when a discharge failure occurs in the first embodiment.

FIG. 12 is a view showing an outline of the relationship between the printing chip 41 and, for example, the array A inspection pattern 121. For descriptive convenience, one nozzle array will be exemplified.

In FIG. 12, 12*a* shows a state in which there are one discharge failure nozzle 114, two adjacent discharge failure nozzles 115, three adjacent discharge failure nozzles 116, and four adjacent discharge failure nozzles 117. In FIG. 12, 12*b* shows the array A inspection pattern 121 printed by the printing chip in the state as shown in 12*a* of FIG. 12. In FIG. 12, 12*c* shows a raw value Raw calculated from the inspection pattern 121 in step S101. The abscissa represents the pixel number of an image, and the ordinate represents the luminance value. In FIG. 12, 12*d* shows a value diff calculated by the difference calculation process in step S102. In the difference calculation process in this analysis, the difference value is calculated using the difference calculation distance d=2 pixels. The difference calculation process for d=2 pixels will be referred to as difference calculation process 1.

In step S103, the image analyzing unit 18 calculates the peak difference value "ΔP" of an inverted difference value in 12*c* of FIG. 12 in order to estimate the number of discharge failure nozzles in pixels.

Figure 13:
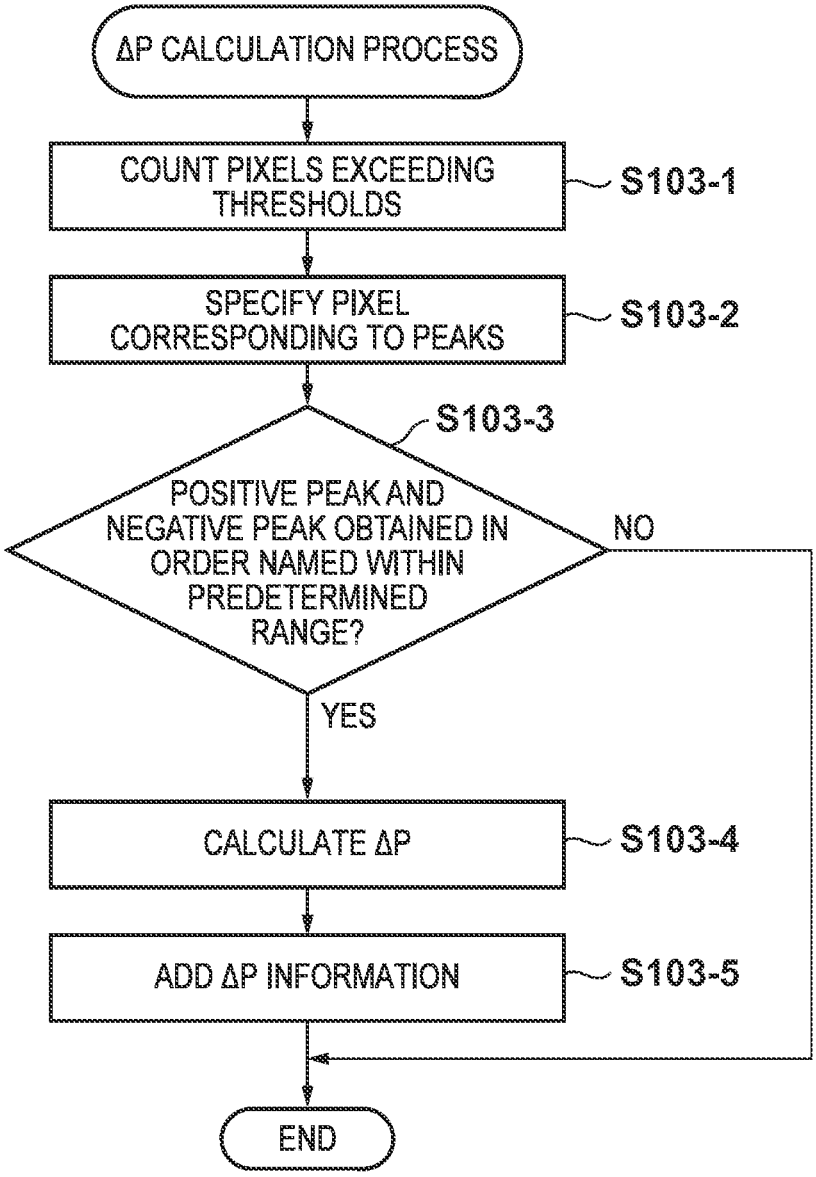
FIG. 13 is a flowchart showing a ΔP calculation process in the first embodiment.
Figure 14:
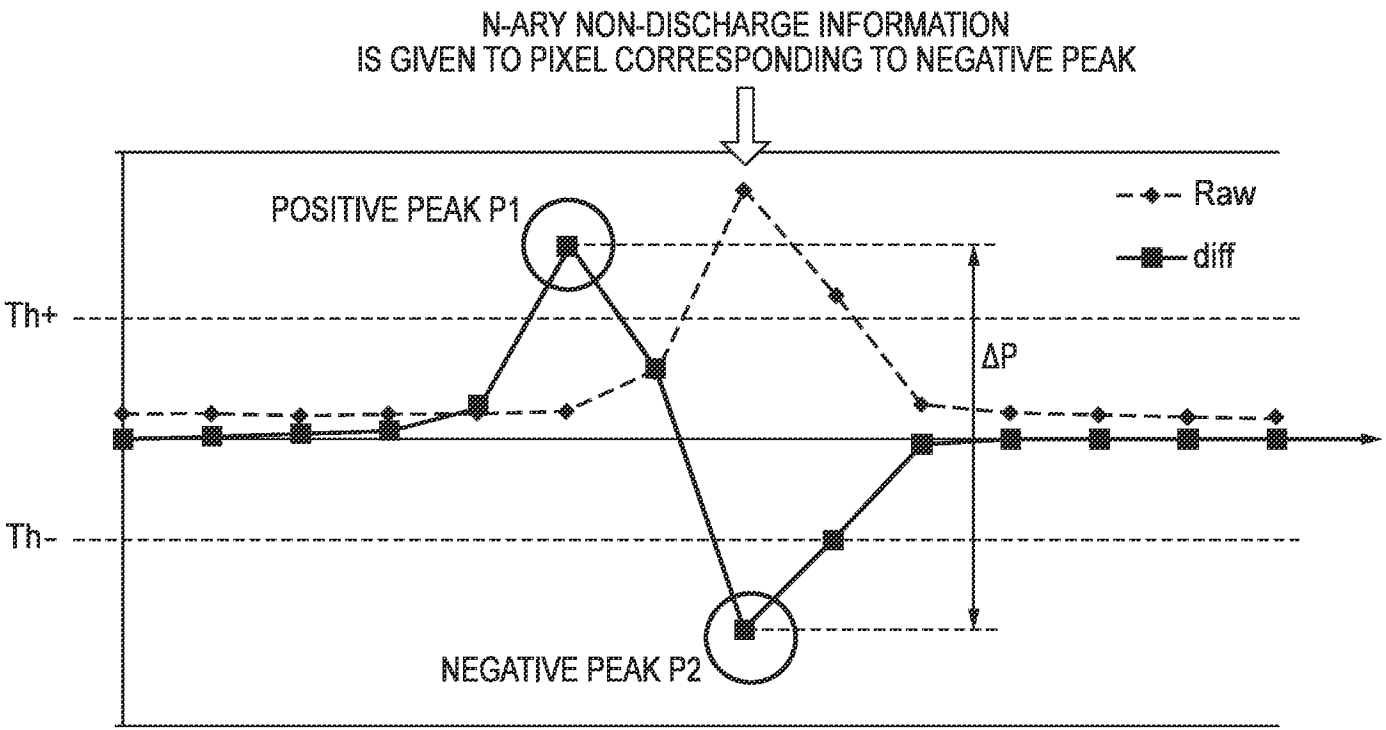
FIG. 14 is a graph for explaining an outline of ΔP in the first embodiment.

FIG. 13 is a flowchart showing details of a "ΔP" calculation process for specifying the number of adjacent discharge failure nozzles. FIG. 14 is a graph for explaining the relationship between the raw value, the difference value, and ΔP. In FIG. 14, "Th+" is a positive threshold value in non-discharge detection, and "Th−" is a negative threshold value in non-discharge detection. Raw is the raw value calculated in step S101, and diff is the difference value calculated in step S102.

In step S103-1 of FIG. 13, the image analyzing unit 18 counts pixels in which difference values obtained by the difference calculation process exceed the threshold. More specifically, the image analyzing unit 18 searches for pixels larger in the difference value than the positive threshold value Th+. If the image analyzing unit 18 detects pixels exceeding Th+, it searches for the local maximum value of the difference value near the pixels exceeding Th+ in step S103-2, and defines it as a positive peak P1. Similarly, the image analyzing unit 18 searches for pixels smaller than Th− near the positive peak P1. If the image analyzing unit 18 detects pixels smaller than Th−, it searches for the local minimum value of the difference value near the pixels smaller than Th− in step S103-2, and defines it as a negative peak P2. In this manner, pixels corresponding to the peaks are specified. Note that Th+ and Th− can be arbitrarily set in accordance with the ink type or the like.

In step S103-3, the image analyzing unit 18 checks whether the positive peak and negative peak are obtained in the order named in ascending order of the position coordinates within a predetermined range. If the image analyzing unit 18 determines that both the positive peak and negative peak are obtained in the order named, it determines that a discharge failure has occurred in a pixel near the negative peak, and calculates a peak difference value (ΔP=P1−P2) in step S103-4. In step S103-5, the image analyzing unit 18 stores information of ΔP (=P1−P2) in correspondence with the pixel corresponding to the negative peak.

The magnitude of ΔP increases in proportion to the number of successive discharge failure nozzles, and thus can be used to estimate the number of successive discharge failure nozzles in pixels. When the luminance of a raw value is 120% or smaller of the average value of the luminance, ΔP is not calculated to prevent a detection error. If the positive peak and negative peak are not obtained in the order named, the process skips steps S103-4 and S103-5 and ends without calculating ΔP. The ΔP calculation process has been described.

Figure 11:
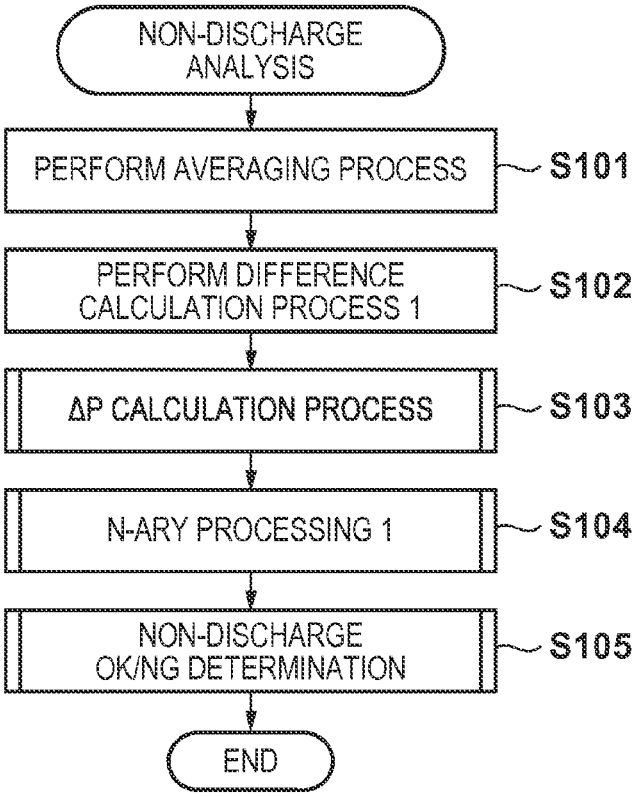
FIG. 11 is a flowchart showing a non-discharge analysis process in the first embodiment.

In step S104, the image analyzing unit 18 executes N-ary processing 1 for ΔP which has been calculated in step S103 of FIG. 11. N-ary processing 1 will be explained with reference to the flowchart of FIG. 15.

In N-ary processing 1, the number of discharge failure nozzles in pixels is estimated from ΔP. More specifically, ΔP is compared with preset thresholds F1 to F4 (F4>F3>F2>F1) to determine the number of successive discharge failure nozzles in pixels.

Figure 15:
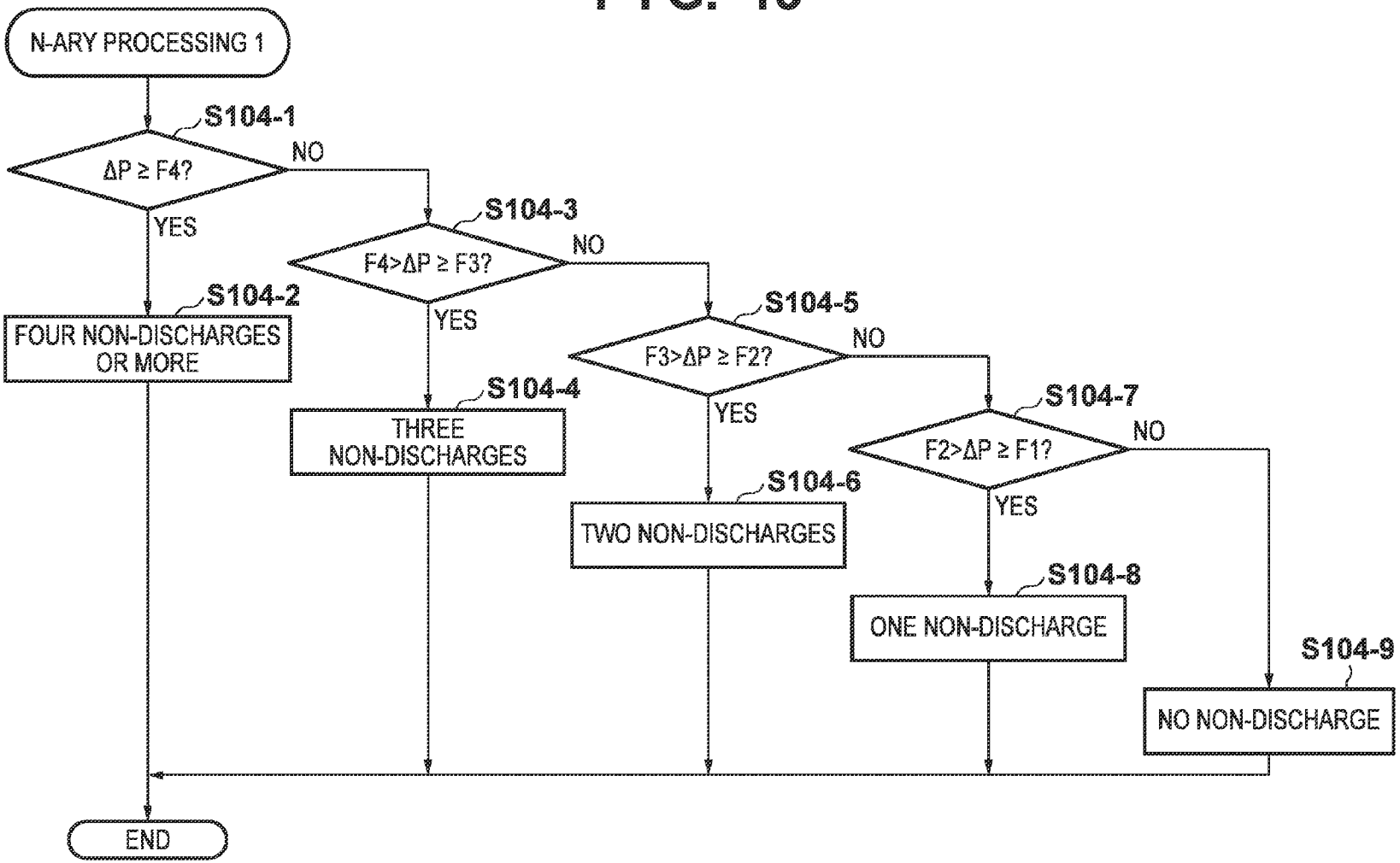
FIG. 15 is a flowchart showing N-ary processing 1 in the first embodiment.

Referring to FIG. 15, ΔP is compared with the threshold F4 in step S104-1. If ΔP≥F4, the process advances to step S104-2 to determine that the number of discharge failure nozzles is four or more. If ΔP<F4, the process advances to step S104-3 to compare ΔP with the threshold F3. If F4>ΔP≥F3, the process advances to step S104-4 to determine that the number of discharge failure nozzles is three. If ΔP<F3, the process advances to step S104-5 to compare ΔP with the threshold F2.

If F3>ΔP≥F2, the process advances to step S104-6 to determine that the number of discharge failure nozzles is two. If ΔP<F2, the process advances to step S104-7 to compare ΔP with the threshold F1. If F2>ΔP≥F1, the process advances to step S104-8 to determine that the number of discharge failure nozzles is one. If ΔP<F1, the process advances to step S104-9 to determine that there is no discharge failure nozzle.

In this case, 5-ary processing corresponding to no discharge failure nozzle, one discharge failure nozzle, two discharge failure nozzles, three discharge failure nozzles, and four or more discharge failure nozzles has been exemplified. However, the present invention is not limited to this. The thresholds F1 to F4 can be arbitrarily set. The expression "corresponding to" is used because, even when an ink droplet landing position shift other than a discharge failure occurs, and the ink-landing shift amount exceeds a predetermined value, the ink droplet landing position shift is handled similarly to a discharge failure, as described in step S1.

Referring back to FIG. 11, whether to continuously perform the printing operation is determined in accordance with the number of successive discharge failure nozzles (step S105). If the number of successive discharge failure nozzles falls within an image quality permissible range, OK is determined; if it falls outside the permissible range, NG is determined. When it is determined not to continuously perform the printing operation, recovery processing in step S73 and non-discharge supplement in step S74 are executed, as shown in FIG. 10.

Since CCD elements which form a line sensor as used in the embodiment are manufactured using a semiconductor process, the detection sensitivities of the respective elements may not be uniform owing to manufacturing variations or the like. If scan data detected by a CCD line sensor formed by arraying CCD elements having a detection sensitivity difference is simply compared with the threshold to specify a discharge failure nozzle, a discharge failure nozzle may not be determined accurately.

Even the printing chips 41 are manufactured using a semiconductor process and may have manufacturing variations. Also, the temperature distribution may be generated in the printing chip along with discharge, and the ink discharge amount may not be constant in the printing chip. When the ink discharge amount has changed, if scan data inspected using an inspection pattern is compared with the threshold to specify a discharge failure nozzle, a discharge failure nozzle may not be determined accurately.

However, even if the detection sensitivity in the scanner is not constant and the ink discharge amount in the nozzle array is not constant, detection processing can be performed at a high S/N ratio of scan data by executing discharge failure nozzle detection processing using difference processing as described in the embodiment. Accordingly, it can be controlled to reliably specify a discharge failure nozzle, and perform the recovery operation and discharge supplement operation for maintaining the image quality.

(Second Embodiment)

In the first embodiment, the peak difference value of a difference value is calculated as ΔP to calculate the number of successive discharge failure nozzles in the non-discharge analysis process. The second embodiment will explain non-discharge analysis to calculate the number of successive discharge failure nozzles using the accumulated value of difference values near a peak, that is, "ΔP accumulated value". This processing replaces the processing in FIG. 13. The remaining processes are the same as those in the first embodiment, and a description thereof will not be repeated.

Figure 16:
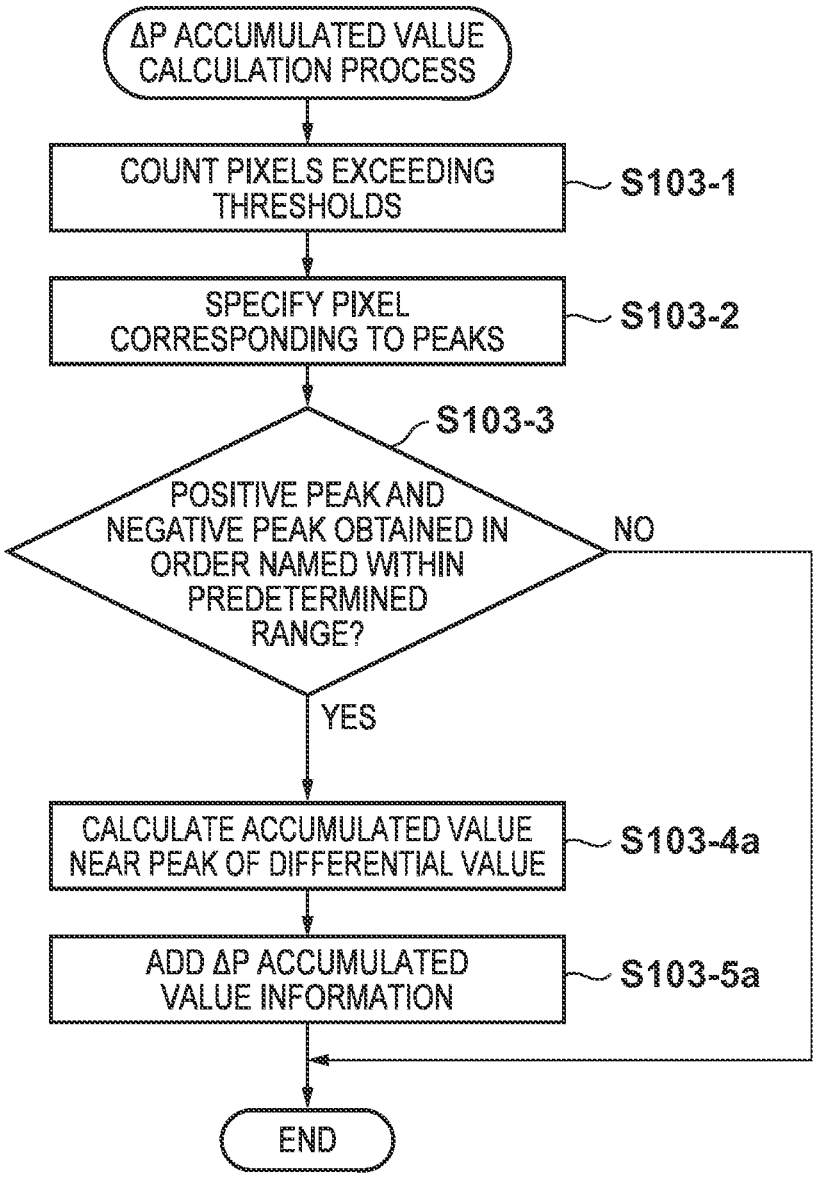
FIG. 16 is a flowchart showing a ΔP accumulated value calculation process in the second embodiment.
Figure 17A:
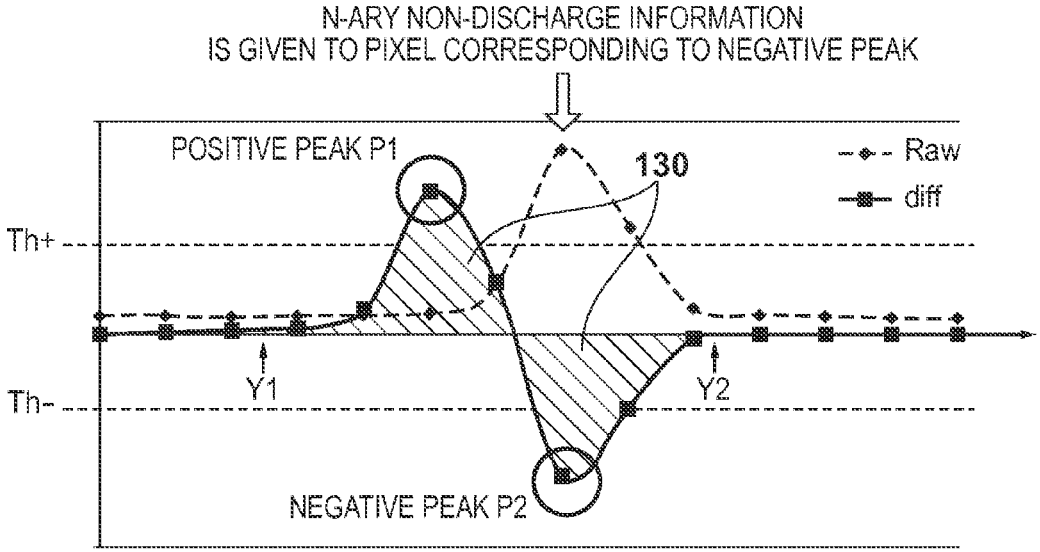
FIGS. 17A and 17B are graphs for explaining an outline of the ΔP accumulated value in the second embodiment.
Figure 17B:
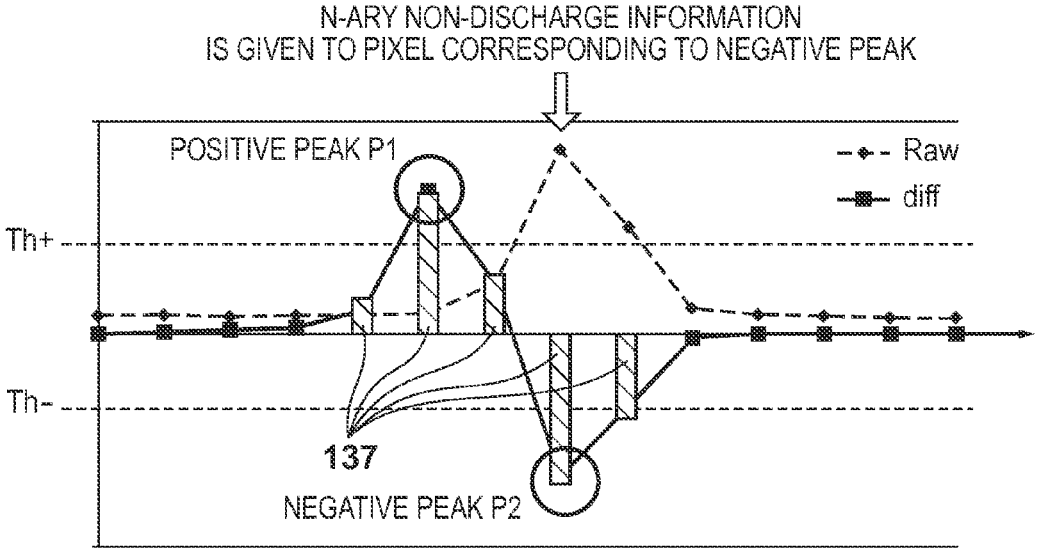

FIG. 16 is a flowchart for explaining details of a ΔP accumulated value calculation process. FIGS. 17A and 17B are graphs for explaining the relationship between the raw value, the difference value, and the ΔP accumulated value. In the flowchart shown in FIG. 16, the same step reference numerals as those in the flowchart of FIG. 13 denote the same processing steps, and a description thereof will not be repeated.

In FIG. 17A, "Th+" is a positive threshold value in non-discharge detection, and "Th−" is a negative threshold value in non-discharge detection. Raw is the raw value calculated in step S101, and diff is the difference value calculated in step S102. Similar to the first embodiment, FIG. 17A shows an example in which the positive peak P1 and negative peak P2 are aligned in ascending order of the position coordinate value (or pixel number) within a predetermined range. By the processes in steps S103-1 to S103-3 of FIG. 16, it can be checked whether the positive peak and negative peak are obtained in the order named in ascending order of the position coordinate value within a predetermined range. If it is determined that the positive peak and negative peak are obtained in the order named, it is determined that a discharge failure nozzle exists in a pixel near the negative peak, and the process advances to step S103-4*a*.

In step S103-4*a*, an approximate function diff on the assumption that difference data draws a curve, and the ΔP accumulated value is calculated by integrating diff:

$$\Delta P \text{ accumulated value} = \int_{Y1}^{Y2} (\text{diff})\, dY \quad (1)$$

In step S103-5*a*, information of the ΔP accumulated value is stored in association with a pixel corresponding to the negative peak. The ΔP accumulated value is represented as the area of regions 130 in FIG. 17A. By executing N-ary processing as shown in FIG. 15 in the first embodiment using this area, the number of successive discharge failure nozzles can be obtained, similar to the first embodiment.

The accumulated value of calculated difference values is used because of the following reason. Even for the same discharge failure, the peak of the luminance value may become narrow and steep, or wide and moderate depending on the relationship between a pixel position detected by a scanner 17 and the position of a blank region generated by a discharge failure in an inspection pattern 121. More specifically, when the blank region completely falls within one pixel, a narrow, steep peak appears. When the blank region lies across two pixels, a wide, moderate peak appears. If only the peak of the difference value is used for analysis, the precision at which the number of discharge failures is analyzed may decrease. However, by using the accumulated value of difference values for analysis as in the second embodiment, a difference arising from the shapes of peaks can be reduced.

In the above example, the accumulated value of difference values is calculated by applying the integral formula to the approximate function which is obtained on the assumption that difference data draws a curve. However, as shown in FIG. 17B, the sum of the absolute values of a peak and pixels preceding and succeeding the peak may be employed as the ΔP accumulated value. In this case, the ΔP accumulated value is defined as ΔP accumulated value=(sum of absolute values of difference values between positive peak and immediately preceding and succeeding pixels)+(sum of absolute values of difference values between negative peak and immediately preceding and succeeding pixels) However, when the calculated difference values of pixels immediately preceding and succeeding a peak have a sign opposite to that of the peak, they are not used to calculate the ΔP accumulated value. Even when a positive peak and negative peak are close to each other, repetitive addition of values between the peaks can be prevented.

In this case, the ΔP accumulated value is represented as the sum of regions 137 in FIG. 17B. Note that pixels preceding and succeeding a peak used to calculate an absolute value are contained in addition calculation regardless of whether the pixel exceeds the threshold Th. This calculation method can simplify calculation and reduce the processing load, compared to the case in which an accumulated value is calculated after obtaining an approximate function, as shown in FIG. 17A.

(Third Embodiment)

In the first and second embodiments, the same analysis method is applied to the entire region of an inspection pattern. The third embodiment will explain a form in which different analysis methods are used in accordance with a Y position on a printing medium. To avoid a repetitive description to the first embodiment, a difference will be mainly explained.

An outline of processing according to the third embodiment will be explained with reference to 18*a* to 18*d* of FIG. 18 and FIG. 19.

Figure 18:
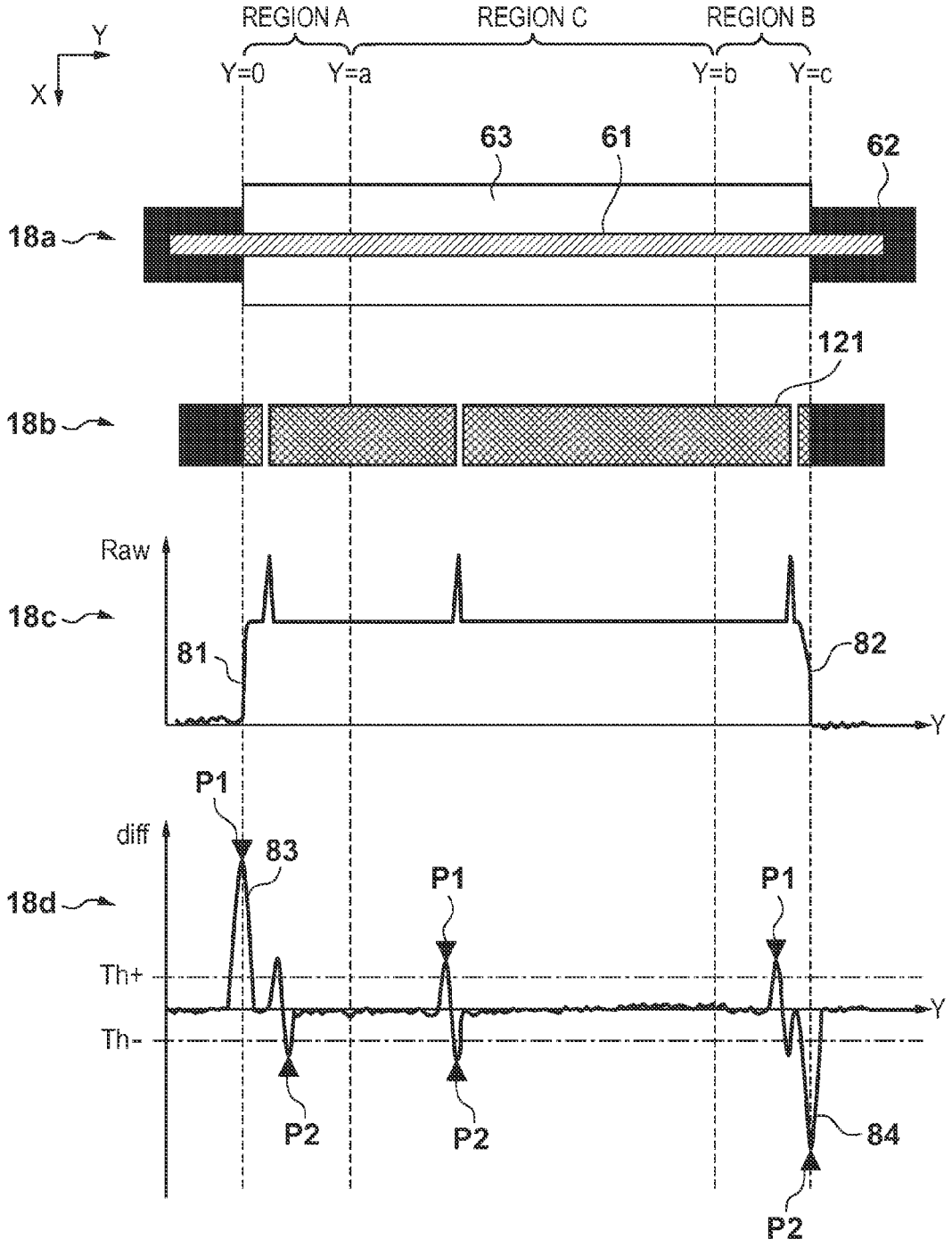
FIG. 18 is a view for explaining an outline of processing in the third embodiment.

In FIG. 18, 18*a* shows an outline of a scanner 17, which is the same as the outline described with reference to FIG. 9. In 18*a* of FIG. 18, one end (left side in 18*a* of FIG. 18) of a printing medium is defined as Y=0, and the other end (right side in 18*a* of FIG. 18) is defined as Y=c. Y=a and Y=b will be described later.

In FIG. 18, 18*b* shows a state in which, for example, an array A inspection pattern 121 is printed on the printing medium. The inspection pattern 121 is printed from Y=0 to Y=c in a marginless style. In the inspection pattern 121, discharge failures each by one nozzle are generated near the left end, right end, and center of the paper in 18*b* of FIG. 18. Hence, regions corresponding to the discharge failures become blank.

In FIG. 18, 18*c* shows a raw value obtained from the inspection pattern 121.

At the positions Y=0 and Y=c, the entire surface of the background is painted in black, the luminance value is almost "0", and thus the raw value abruptly changes between a background 62 of the scanner 17 and the inspection pattern 121. If the background which generates an abrupt luminance change exists near the inspection pattern 121, an affected region is generated even in the inspection pattern. Regions (reference numerals 81 and 82) where the raw value changes abruptly under the influence of the background are called end-side regions. In FIG. 18, 18*c* shows a raw value for black ink. The remaining ink colors are higher in brightness than black ink, so an end-side region wider than that of black ink is generated.

In FIG. 18, 18*d* shows difference data obtained by performing difference calculation process 1 described in the first embodiment using the raw value in 18*c* of FIG. 18. In 18*d* of FIG. 18, large peaks (difference values 83 and 84) based on the end-side regions are generated near Y=0 and Y=c, in addition to difference values arising from three discharge failures described above. The difference value 83 based on the end-side region near Y=0 exhibits a concaved-down shape, and the difference value 84 based on the end-side region near Y=c exhibits a concaved-up shape.

When performing the ΔP calculation process as described in the first embodiment, erroneous peaks may be used as the peaks of the difference values 83 and 84 in the end-side regions Y=0 and Y=c.

More specifically, when the ΔP calculation process described with reference to FIG. 13 in the first embodiment is executed, a lower triangular code denoted by reference numeral 83 and an upper triangular code denoted by reference numeral 84 are detected as a local maximum value P1 and local minimum value P2. If discharge failure nozzles exist near the end-side regions of a printing medium, the ΔP calculation process is performed using erroneous peaks under the influence of the peaks 83 and 84 generated by the background.

A region where a peak generated by the background may be erroneously detected is a region (first end-side region) of about 1 mm to 2 mm from the end of a printing medium.

Figure 19:
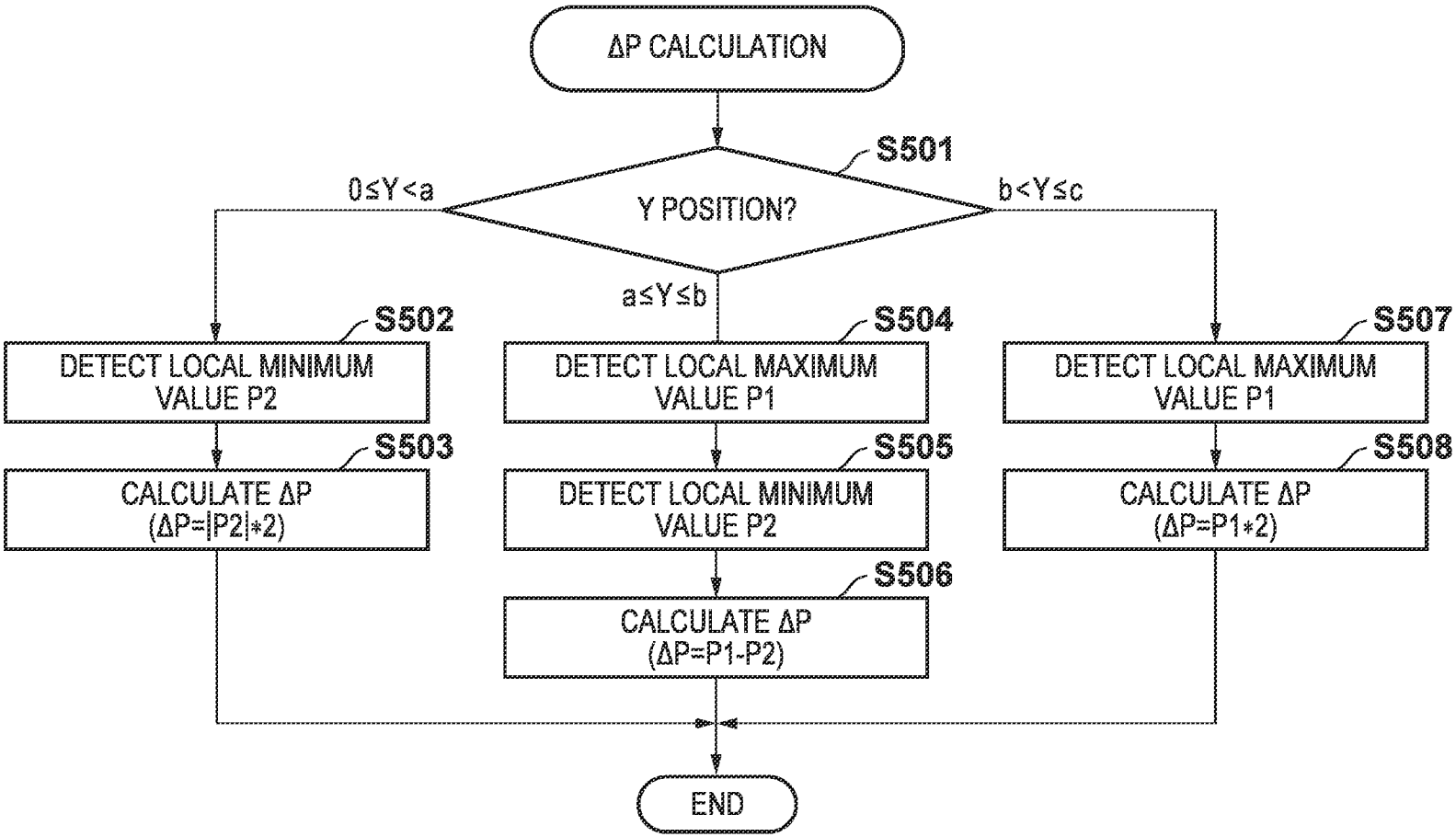
FIG. 19 is a flowchart showing a ΔP calculation process in the third embodiment.

In the third embodiment, therefore, the printing medium is divided into three regions in the Y direction (nozzle arrayed direction), and different ΔP calculation processes are performed in accordance with a position on the printing medium, as shown in FIG. 19. More specifically, different ΔP calculation processes are performed separately for region A of a predetermined range (0≤Y<a) from one end of the printing medium, region B of a predetermined range (b<Y≤c) from the other end of the printing medium, and remaining central region C (a≤Y≤b) of the printing medium, wherein a and b are set so that regions A and B become wider than regions where a peak generated by the background may be erroneously detected. At the three divided Y positions, ΔP is calculated by different processes.

In this ΔP calculation process, first, a printing apparatus 20 determines a region of paper in the Y direction from which a difference value has been obtained as a signal (step S501). If the printing apparatus 20 determines that the difference value has been obtained from region A (0≤Y<a), it detects the local minimum value P2 (step S502). The absolute value of the local minimum value P2 is doubled, calculating ΔP (step S503). As a result, ΔP in region A can be calculated without the influence of the background near Y=0.

If the printing apparatus 20 determines in step S501 that the difference value has been obtained from region B (b<Y≤c), it detects the local maximum value P1 (step S507). The local maximum value P1 is doubled, calculating ΔP (step S508). ΔP in region B can be calculated without the influence of the background near Y=c.

If the printing apparatus 20 determines in step S501 that the difference value has been obtained from region C (a≤Y≤b), it detects the local maximum value P1 and local minimum value P2 (steps S504 and S505). In this case, ΔP (=P1−P2) is calculated by the same processing as that in the first embodiment (step S506).

As described above, according to the third embodiment, the printing apparatus 20 obtains ΔP using three different processing methods in accordance with a Y position on a printing medium. High-reliability ΔP can be calculated in the entire region without the influence of the background.

By executing N-ary processing as shown in FIG. 15 in the first embodiment using ΔP, a discharge failure nozzle can be specified. Even if the detection sensitivity varies in the scanner or unevenness of the ink discharge amount is generated in the nozzle array, it can be controlled to reliably specify a discharge failure nozzle, and perform the recovery operation and discharge supplement operation for maintaining the image quality.

When the background of the scanner 17 is white, the orientation of the concave shape of a difference value is reversed from the above-described one (when the background is black). In this case, processes for the left and right end-side regions of paper are exchanged in calculation of the peak difference ΔP. In the above description, the non-discharge detection method has been described using an example of calculating ΔP. However, a discharge failure nozzle may be specified using the ΔP accumulated value described in the second embodiment.

(Fourth Embodiment)

In the first and second embodiments, the same analysis method is applied to the entire region of an inspection pattern. In the fourth embodiment, the analysis method changes in accordance with a Y position on a printing medium. To avoid a repetitive description to the first embodiment, a difference will be mainly explained. A difference from the first embodiment is the ΔP calculation process in step S103 of FIG. 11.

An outline of processing according to the fourth embodiment will be explained with reference to 20*a* to 20*d* of FIG. 20 and FIG. 21.

Figure 20:
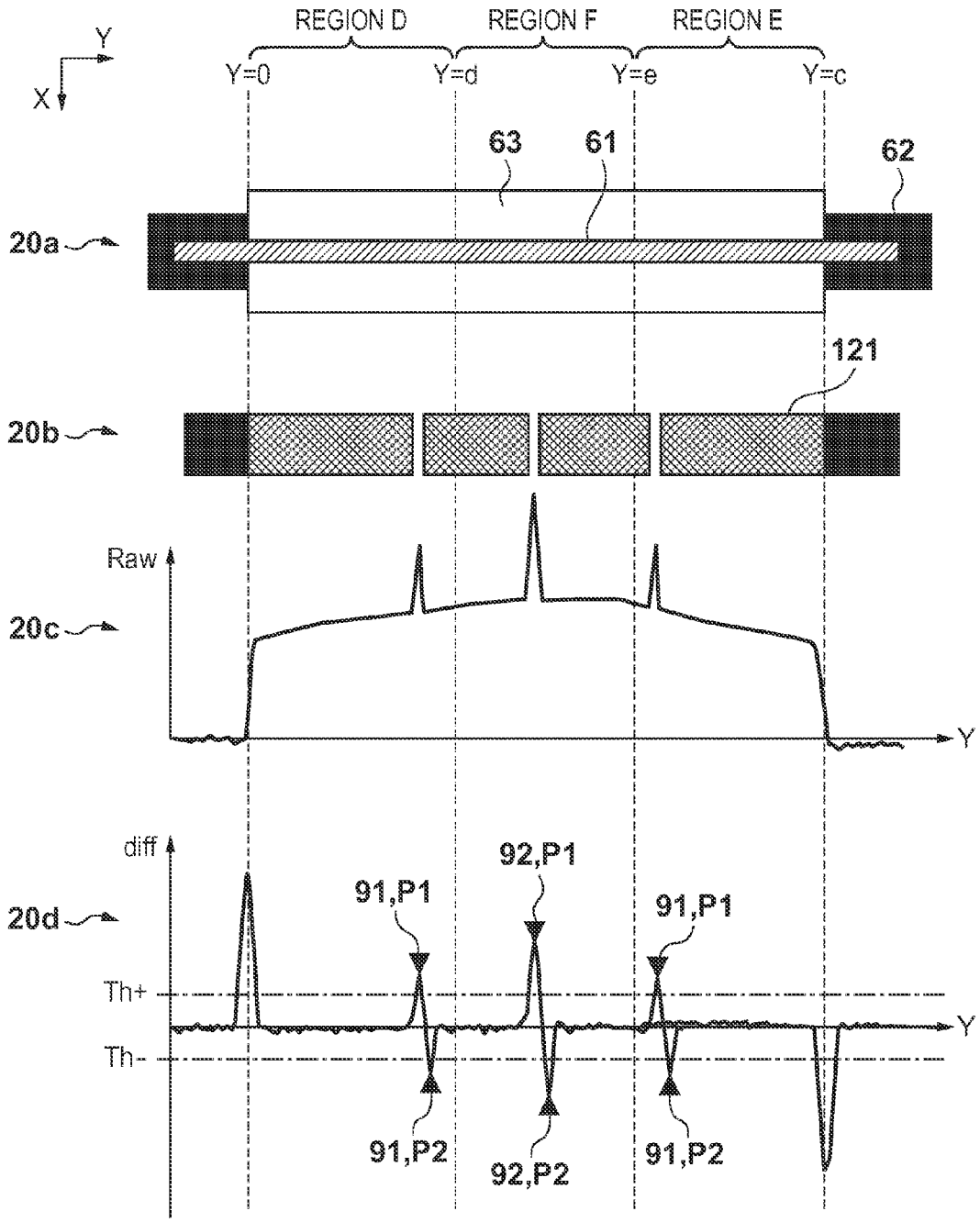
FIG. 20 is a view for explaining an outline of processing in the fourth embodiment.

In FIG. 20, 20*a* shows an outline of a scanner 17, which is the same as the outline described with reference to FIG. 9. In 20*a* of FIG. 20, one end (left side in 20*a* of FIG. 20) of a printing medium is defined as Y=0, and the other end (right side in 20*a* of FIG. 20) is defined as Y=c. Y=d and Y=e will be described later.

For example, an array A inspection pattern 121 shown in 20*b* of FIG. 20 is printed from Y=0 to Y=c in a marginless style. In the array A inspection pattern 121, discharge failures each by one nozzle are generated in region D (0≤Y<d), region E (e<Y≤c), and region F (d≤Y≤e) on a printing medium. Hence, regions corresponding to the discharge failures become blank.

In FIG. 20, 20*c* shows a raw value acquired from the array A inspection pattern 121. The abscissa represents the pixel number, and the ordinate represents the luminance value.

A luminance value read by the scanner 17 should be originally almost constant except for a portion where a discharge failure exists. However, the luminance value sometimes draws a moderate curve having a concaved-down shape at the center of a printing medium, as shown in 20*c* of FIG. 20. In this state, even for a discharge failure generated by the same nozzle, the magnitude of a peak arising from the discharge failure may change.

In FIG. 20, 20*d* shows a difference value obtained by performing a difference calculation process using the raw value as shown in 20*c* of FIG. 20. Similar to 20*c* of FIG. 20, even for a discharge failure in the same nozzle, the magnitude of the peak differs between a peak 92 in central region F of the printing medium, and peaks 91 in regions D and E. If the ΔP calculation process is executed in this state, it becomes difficult to accurately specify the discharge failure nozzle.

A conceivable cause of this phenomenon is reflection of light by a background 62 of the scanner 17. As the scanner 17 and background 62 are closer to each other, the influence of reflected light becomes larger. The degree of influence of reflected light changes depending on the hue and density of the background 62. For example, a raw value in the end-side region of a printing medium becomes larger than an original value obtained from the inspection pattern when the background 62 is white, and smaller than an original value obtained from the inspection pattern when the background 62 is black. Since a black background less affects non-discharge detection processing, the embodiment employs the black background 62. Note that the background may have the influence in a region (second end-side region) of about 10 mm to 20 mm from the end of a printing medium.

Figure 21:
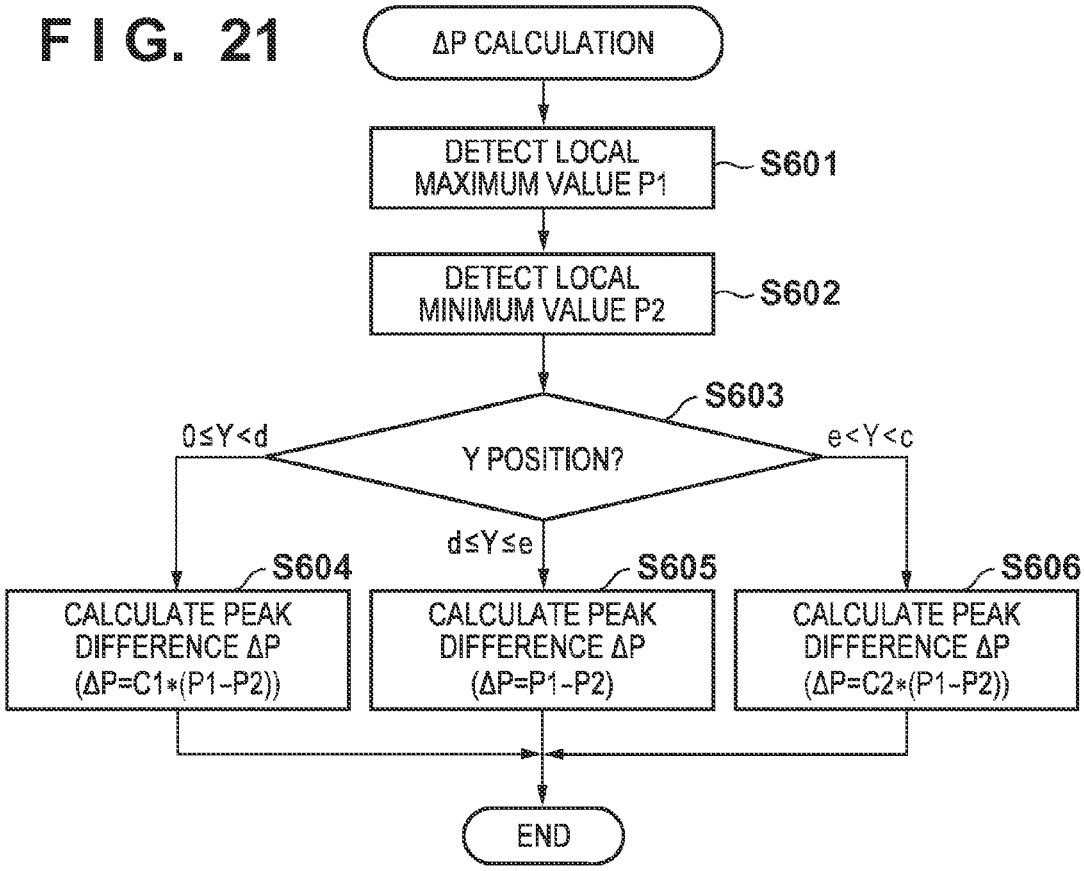
FIG. 21 is a flowchart showing a ΔP calculation process in the fourth embodiment.

Considering this, in the fourth embodiment, the printing medium is divided into three regions in the Y direction (nozzle arrayed direction), and different ΔP calculation processes are performed in accordance with a position on the printing medium, as shown in FIG. 21. More specifically, different ΔP calculation processes are performed separately for region D of a predetermined range ($0 \le Y < d$) from one end of the printing medium, region E of a predetermined range ($e < Y \le c$) from the other end of the printing medium, and remaining central region F ($d \le Y \le e$) of the printing medium, wherein d and e are set to contain regions where the influence of the background appears seriously. At the three divided Y positions, ΔP is calculated by different processes.

In the ΔP calculation process, a printing apparatus 20 calculates a local maximum value P1 and local minimum value P2, similar to FIG. 13 according to the first embodiment (steps S601 and S602).

Then, the printing apparatus 20 determines a region of paper in the Y direction from which a difference value has been obtained as a signal (step S603). If the printing apparatus 20 determines that the difference value has been obtained from region D ($0 \le Y < d$), it multiplies ΔP by a correction coefficient C1 (step S604). If the difference value has been obtained from region E ($e < Y \le c$), the printing apparatus 20 multiplies ΔP by a correction coefficient C2 (step S606). Since regions D and E are highly likely to be affected by the background, the S/N ratio of the scanner 17 may decrease. To correct the influence, ΔP is multiplied by the correction coefficients C1 and C2.

Note that the correction coefficients C1 and C2 suffice to be obtained in advance by experiment or the like. If the position of a peak detected in a region of a predetermined range from the end of a printing medium is horizontally symmetrical about the center, the correction coefficients C1 and C2 may be equal to each other.

If the printing apparatus 20 determines in step S603 that the calculated difference value has been obtained from region F ($d \le Y \le e$), it calculates ΔP (=P1−P2) by the same processing as that in the first embodiment (step S605).

As described above, according to the fourth embodiment, ΔP is obtained using three different processing methods in accordance with a Y position on a printing medium. High-reliability ΔP can be calculated in the entire region without the influence of the background.

By executing N-ary processing as shown in FIG. 15 in the first embodiment using ΔP, a discharge failure nozzle can be specified. Even if the detection sensitivity varies in the scanner or unevenness of the ink discharge amount is generated in the nozzle array, it can be controlled to reliably specify a discharge failure nozzle, and perform the recovery operation and discharge supplement operation for maintaining the image quality.

In the above description, the S/N ratio is corrected by multiplying ΔP by a correction coefficient. However, the present invention is not limited to this, and the non-discharge determination threshold may be multiplied by a correction coefficient. For example, each of thresholds F1 to F4 may be divided into three in the Y direction, and the divided threshold may be multiplied by a predetermined constant (for example, C1 or C2) in accordance with the region.

Processing according to the third embodiment and processing according to the fourth embodiment have been explained separately, but may be executed in combination with each other. In the above description, the non-discharge detection method has been explained using an example of calculating ΔP. However, a discharge failure nozzle may be specified using the ΔP accumulated value described in the second embodiment.

(Fifth Embodiment)

The fifth embodiment will be described. Processing in the fifth embodiment will be explained as a modification to the fourth embodiment. A problem to be solved by the fifth embodiment is the same as that in the fourth embodiment, and is a decrease in the S/N ratio of a signal read by a scanner 17 under the influence of the background in the end-side region of a printing medium. To avoid a repetitive description to the fourth embodiment, a difference will be mainly explained. A difference is the ΔP calculation process in step S103 of FIG. 11.

Figure 22:
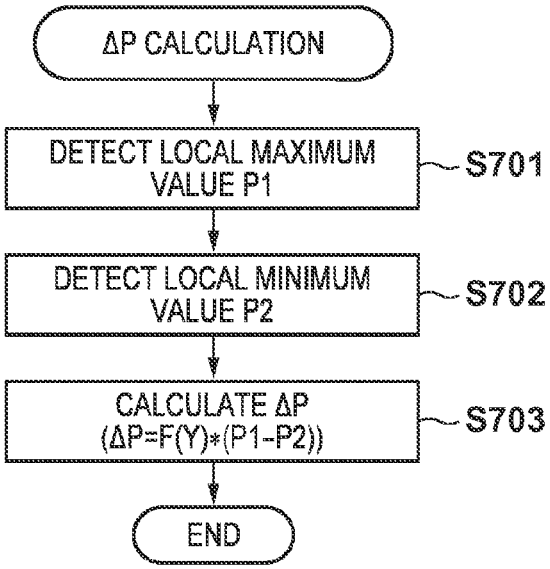
FIG. 22 is a flowchart showing a ΔP calculation process in the fifth embodiment.

The sequence of a ΔP calculation process according to the fifth embodiment will be explained with reference to FIG. 22. Step S701 corresponds to step S601 in the fourth embodiment (FIG. 21). Step S702 corresponds to step S602 in the fourth embodiment (FIG. 21). A difference from the fourth embodiment in the peak difference ΔP calculation process is an equation for calculating ΔP in step S703. In the fifth embodiment, a correction coefficient for correcting the S/N ratio of the scanner 17 is given by F(Y).

This correction coefficient is a continuous function regarding the Y position, unlike the correction coefficient described in the fourth embodiment. That is, the correction coefficient F(Y) is a value corresponding to a distance from the end of paper. Therefore, the fifth embodiment can correct the S/N ratio of the scanner 17 at higher precision than in the fourth embodiment.

As described above, according to the fifth embodiment, ΔP is multiplied by the correction coefficient continuous in the Y direction. This can reduce the influence of a decrease in the S/N ratio of the scanner. In the above description, the S/N ratio is corrected by multiplying ΔP by the correction coefficient. However, the present invention is not limited to this, and the non-discharge determination threshold may be multiplied by a correction coefficient.

More specifically, variables F4(Y), F3(Y), F2(Y), and F1(Y) continuous in the Y direction are used instead of the non-discharge determination thresholds F1 to F4 (constants). Even in this case, the same effects as those obtained when ΔP is multiplied by the correction coefficient can be obtained.

Correction can be performed at higher precision because the correction coefficient for the non-discharge determination threshold is changed, unlike the case in which ΔP is multiplied by the correction coefficient. Even when the non-discharge determination threshold is multiplied by the correction coefficient, the influence of a decrease in the S/N ratio of the scanner 17 can be reduced.

Processing according to the third embodiment and processing according to the fifth embodiment may be executed in combination with each other.

In the above description, ΔP is calculated as the non-discharge detection method. However, a discharge failure nozzle may be specified using the ΔP accumulated value described in the second embodiment.

(Sixth Embodiment)

In the first to fifth embodiments, a discharge failure nozzle is detected using a blank region in the inspection pattern 121 that is generated by the discharge failure nozzle. In some cases, however, even when ink is attached onto an inspection pattern to generate a discharge failure, non-discharge detection processing is not executed accurately. To prevent this, in the sixth embodiment, ink attached onto an inspection pattern is detected, in addition to non-discharge detection described in the first embodiment.

Figure 23:
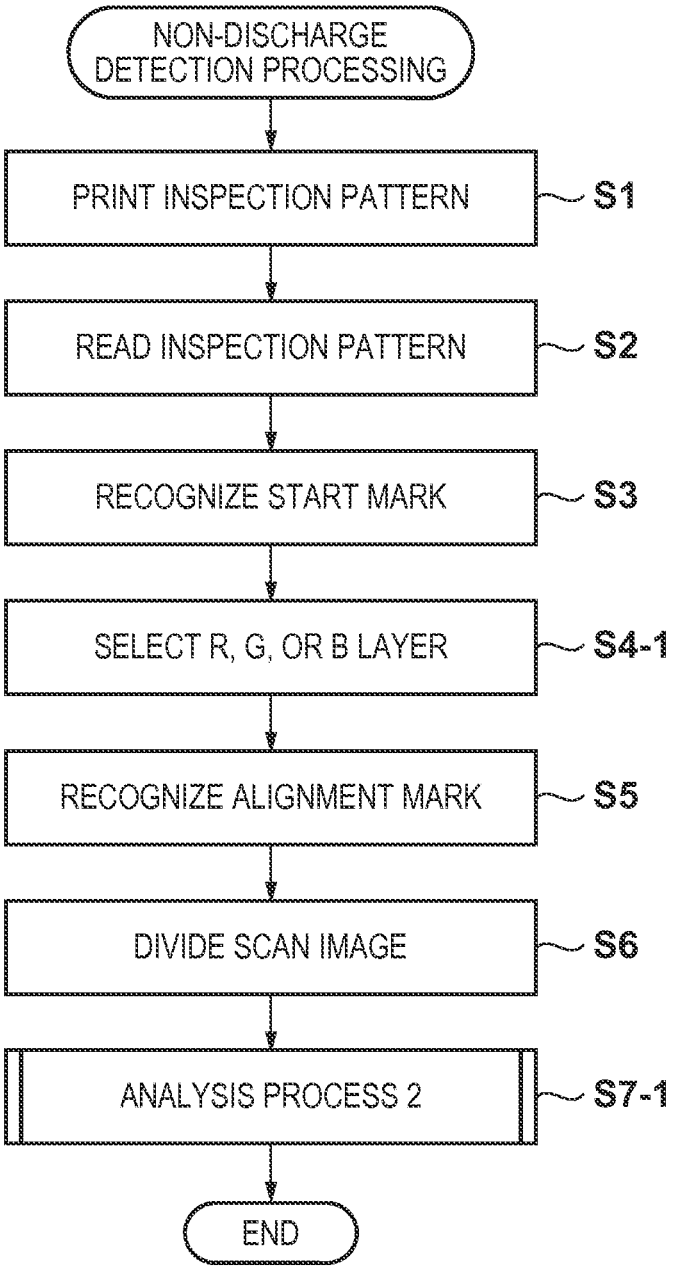
FIG. 23 is a flowchart for explaining non-discharge detection processing in the sixth embodiment.

FIG. 23 is a flowchart showing non-discharge detection processing according to the sixth embodiment. In FIG. 23, the same step reference numerals as those described in FIG. 8 denote the same processes. Steps S1 to S3, and steps S5 and S6 are the same processes as those in the first embodiment, and a description thereof will not be repeated.

Figure 24A:
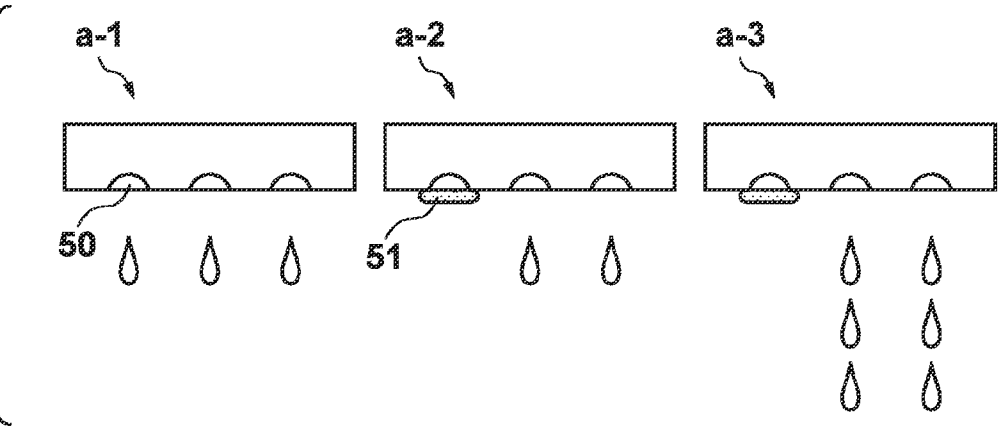
FIGS. 24A and 24B are views for explaining ink dripping arising from a discharge failure in the sixth embodiment.
Figure 24B:
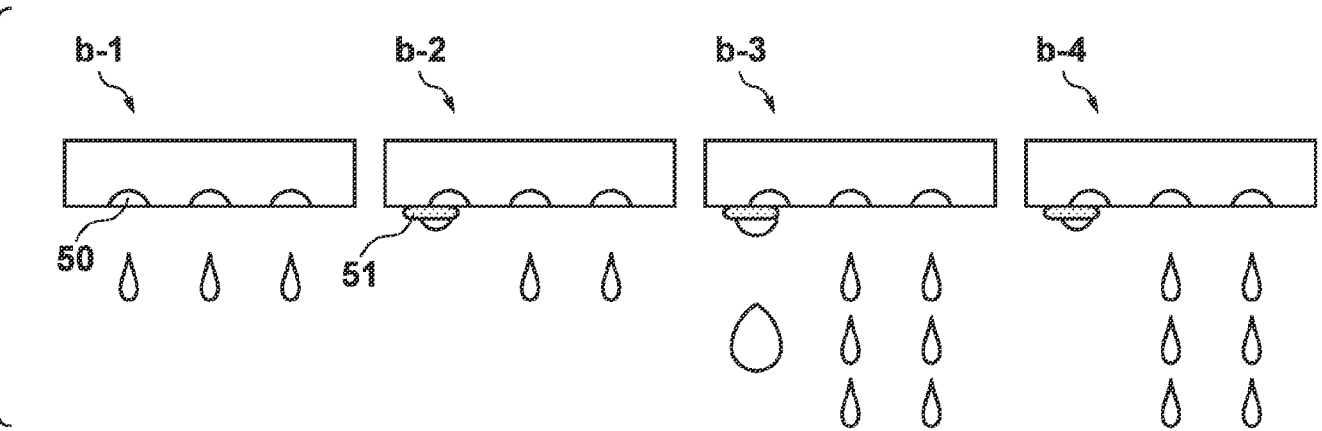

A cause of attaching ink onto an inspection pattern will be explained with reference to FIG. 24A and FIG. 24B. FIG. 24A and FIG. 24B are a view schematically showing a situation in which dust is attached near a nozzle orifice to generate a discharge failure. In a-1 of FIG. 24A and b-1 of FIG. 24B, a situation in which dust is not attached near a nozzle orifice is shown. FIG. 24A shows a case in which dust 51 is attached to completely cover a discharge orifice 50. In this case, no ink is discharged, as shown in a-2 and a-3 of FIG. 24A, and a blank region is formed in the inspection pattern.

FIG. 24B shows a state in which the dust 51 covers part of the discharge orifice 50 and ink is partially discharged. In this case, the partially discharged ink stays near the attached dust 51, as shown in b-2 and b-4 of FIG. 24B, and drips at the timing when the nozzle duty becomes high or the timing when the ink reaches a predetermined amount, as shown in b-3 of FIG. 24B. If ink drips onto the inspection pattern owing to this phenomenon, non-discharge detection processing cannot be performed accurately. The ink may or may not drip onto the inspection pattern depending on the attachment of the dust 51, as shown in b-2 of FIG. 24B.

Ink readily drips onto the inspection pattern when the ink discharge amount per unit area is large (duty is high). For this reason, an inspection pattern is printed at a duty higher than that in image printing to cause ink dripping so that this state can be easily confirmed.

Figure 25:
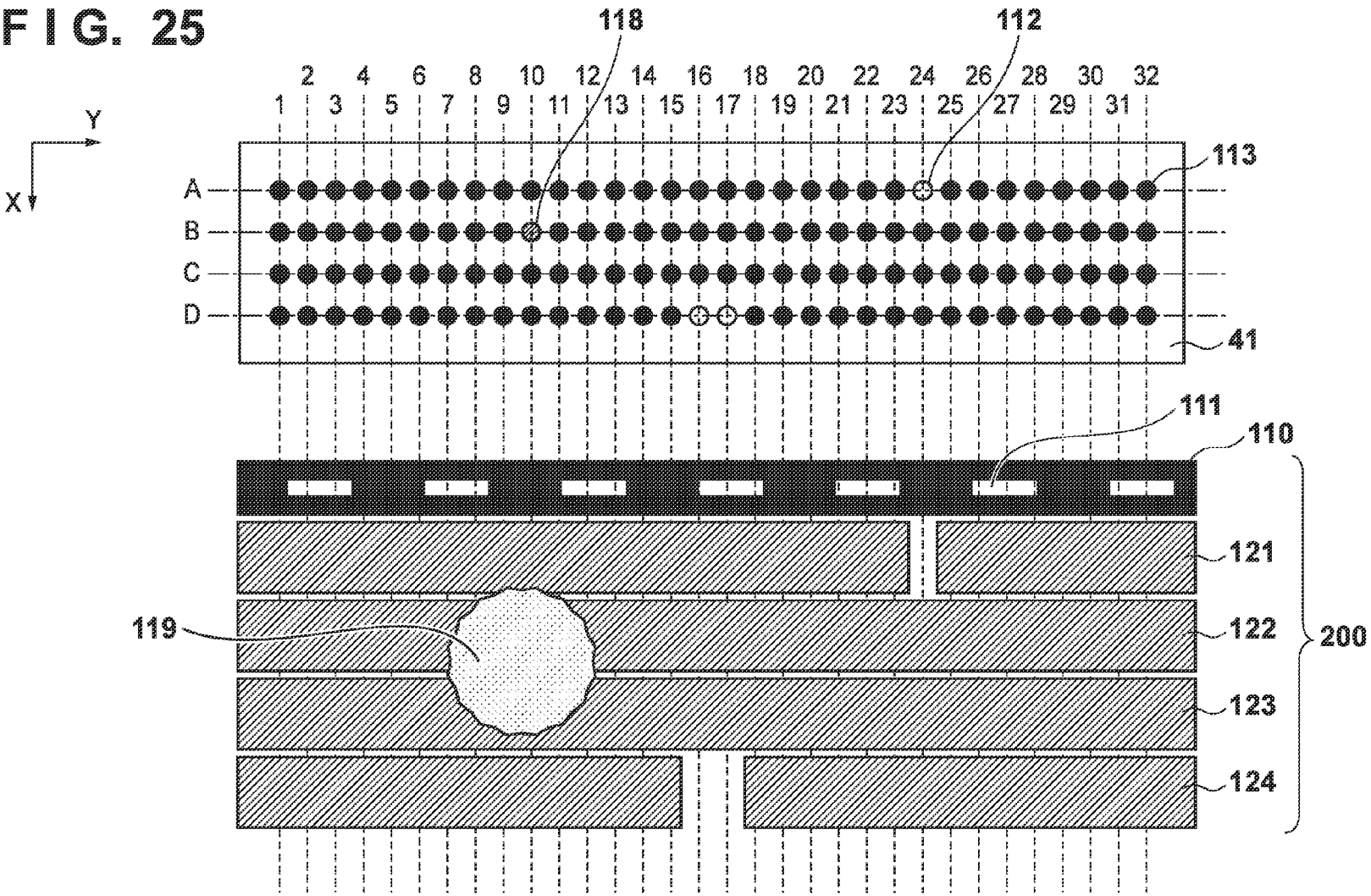
FIG. 25 is a view showing the relationship between the printhead and an inspection pattern when ink drips in the sixth embodiment.

FIG. 25 is a view showing the relationship between the printhead and a printed inspection pattern when ink drips onto the printed inspection pattern. In FIG. 25, the dust 51 or the like is attached to a discharge failure nozzle 118 (shaded circle). An open circle 112 and filled circle 113 represent a discharge failure nozzle and discharge nozzle, respectively. In the example of FIG. 25, ink drips from the 10th nozzle of array B, and a high-ink-density portion 119 exists on part of the inspection pattern of arrays B and C.

Referring back to FIG. 23, in step S4-1, a printing apparatus 20 selects an R, G, or B layer for performing analysis for each ink type. More specifically, analysis is performed using the G (Green) layer for the Bk and M inspection patterns, the R (Red) layer for the C inspection pattern, and the B (Blue) layer for the Y inspection pattern.

In the sixth embodiment, one of the R, G, and B layers is selected to perform analysis in both non-discharge analysis and ink dripping analysis executed in analysis process 2 (to be described later). However, ink dripping analysis may be executed for all the R, G, and B layers in order to increase the detection precision because, when ink drips, the ink droplet may drip onto an inspection pattern of another ink.

Finally, in step S7-1, analysis process 2 is performed for the divided image. Then, non-discharge detection processing ends.

Figure 26:
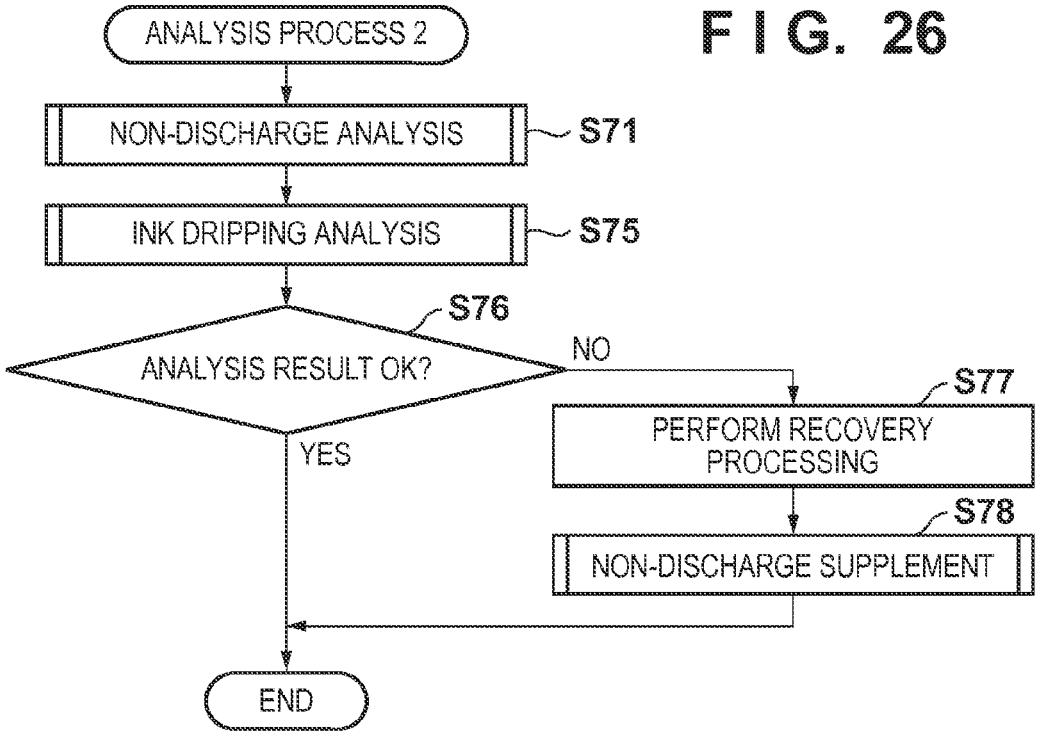
FIG. 26 is a flowchart showing analysis process 2 in the sixth embodiment.

Detailed processing to be performed in analysis process 2 will be described. FIG. 26 is a flowchart showing analysis process 2. As analysis process 2, the embodiment executes discharge failure analysis (step S71) for detecting a discharge failure nozzle, the ink-landing position shift of an ink droplet, and the like, and ink dripping analysis (step S75) for detecting ink dripped onto the inspection pattern. In step S76, an image analyzing unit 18 determines, based on the analysis results in steps S71 and S75, whether to continuously perform the printing operation, that is, whether these analysis results are OK. If the image analyzing unit 18 determines that both of these analysis results are OK, printing continues without performing any processing. If the image analyzing unit 18 determines that either analysis result is NG, printing is interrupted, and the process advances to step S77 to perform recovery processing. In step S78, non-discharge supplement is executed.

In recovery processing according to the sixth embodiment, suction wiping is performed for the nozzle, similar to the first embodiment. Even when it is determined that the result of ink dripping analysis is NG, non-discharge supplement is performed because ink dripping sometimes occurs owing to a discharge failure, as described with reference to FIG. 24B. For the same reason as that described in the first embodiment, non-discharge supplement may be executed immediately without performing recovery processing, in terms of shortening of the time and maintenance of the state.

In the sixth embodiment, suction wiping is performed as recovery processing. However, another operation such as blade wiping, suction recovery, or nozzle pressurization other than suction wiping may be performed. The non-discharge supplement method is also the same as that described in the first embodiment.

Ink dripping analysis (step S75) in the above-described analysis process 2 will be described in detail with reference to the flowchart of FIG. 27. Note that discharge failure analysis (step S71) is the same as that described in the first embodiment, and a description thereof will not be repeated.

In step S201, the printing apparatus 20 calculates a raw value by performing the same averaging process as that in non-discharge analysis step S101. In step S202, the printing apparatus 20 calculates difference value 2 by performing difference calculation process 2, similar to step S102.

Figure 28:
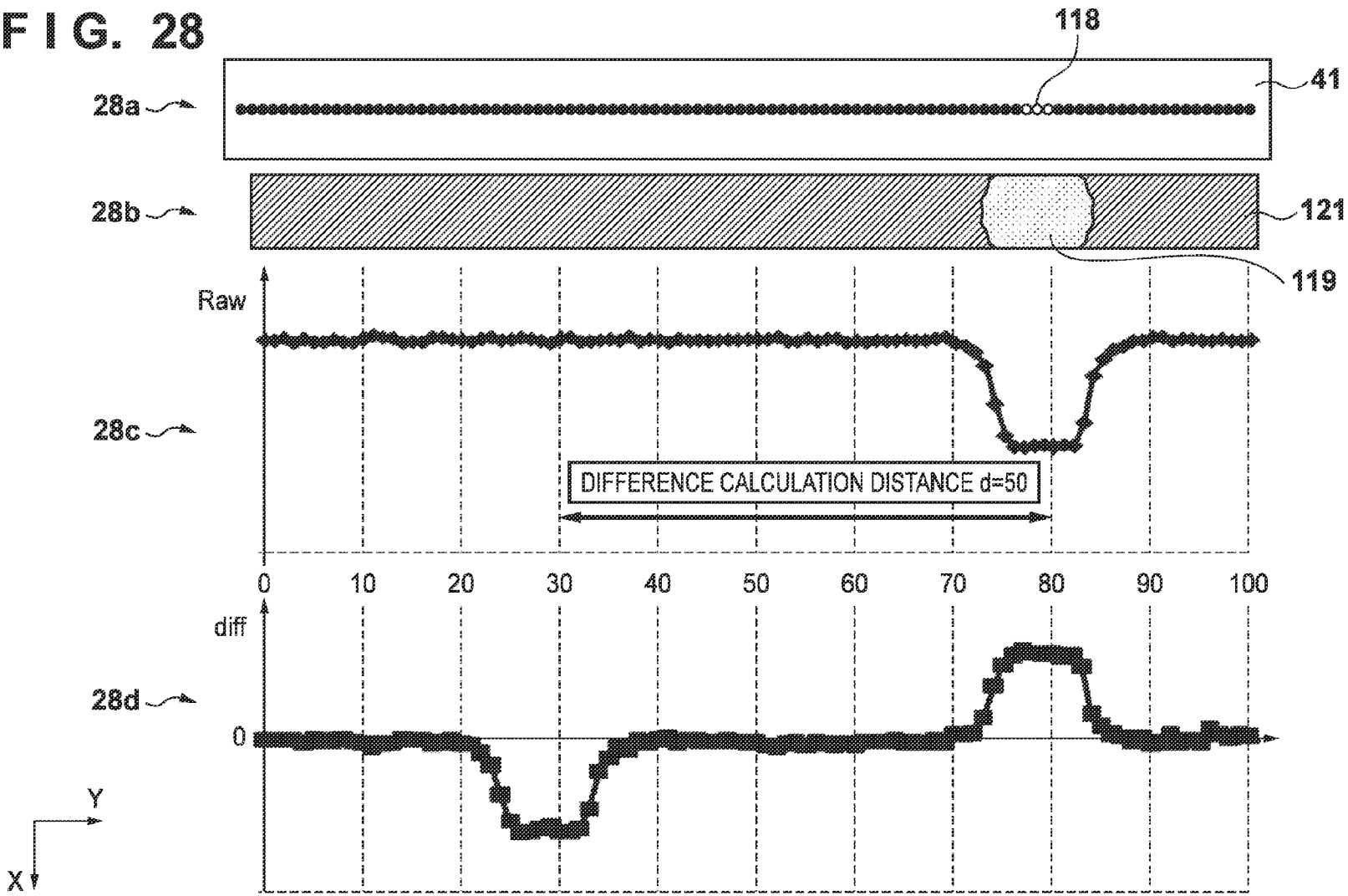
FIG. 28 is a view for explaining the relationship between the inspection pattern state, the raw value, and the difference value when ink drips in the sixth embodiment.

FIG. 28 is a view showing the relationship between the printing chip 41 and, for example, an array A inspection pattern 121 when ink drips onto the inspection pattern. In FIG. 28, 28*a* shows a situation in which ink (portion 119) drips onto the inspection pattern. In FIG. 28, 28*b* shows a state in which ink drips onto the array A inspection pattern 121 to generate the high-density portion 119. In FIG. 28, 28*c* shows a raw value Raw calculated in step S201. The abscissa represents the pixel number of an image, and the ordinate represents the luminance value. In FIG. 28, 28*d* shows a difference value diff calculated by difference calculation process 2 in step S202. Difference calculation process 2 in ink dripping analysis uses the distance d=50 pixels, which is larger than the difference calculation distance in non-discharge analysis.

The examination by the inventor of the present invention reveals that the width of a blank region on the inspection pattern 121 upon generation of discharge failures 1 to 4 determined in N-ary processing 1 described in step S104 was about 10 μm to 80 μm. In most cases, the variation of the luminance value upon ink dripping is several hundred μm or more. That is, the variation of the luminance value upon ink dripping is larger than that of the luminance value upon generation of a discharge failure. If processing is executed using the distance for calculating a difference as in non-discharge analysis, no peak may be detected. To prevent this, difference calculation process 2 is performed using a distance larger than the distance for calculating a difference in discharge failure analysis, thereby reliably detecting a peak.

In step S203, a calculation process for "ΔP arising from ink dripping", which is the difference between the local maximum value and local minimum value of difference values, is executed to detect ink attached near a pixel owing to ink dripping other than printing.

Figure 29:
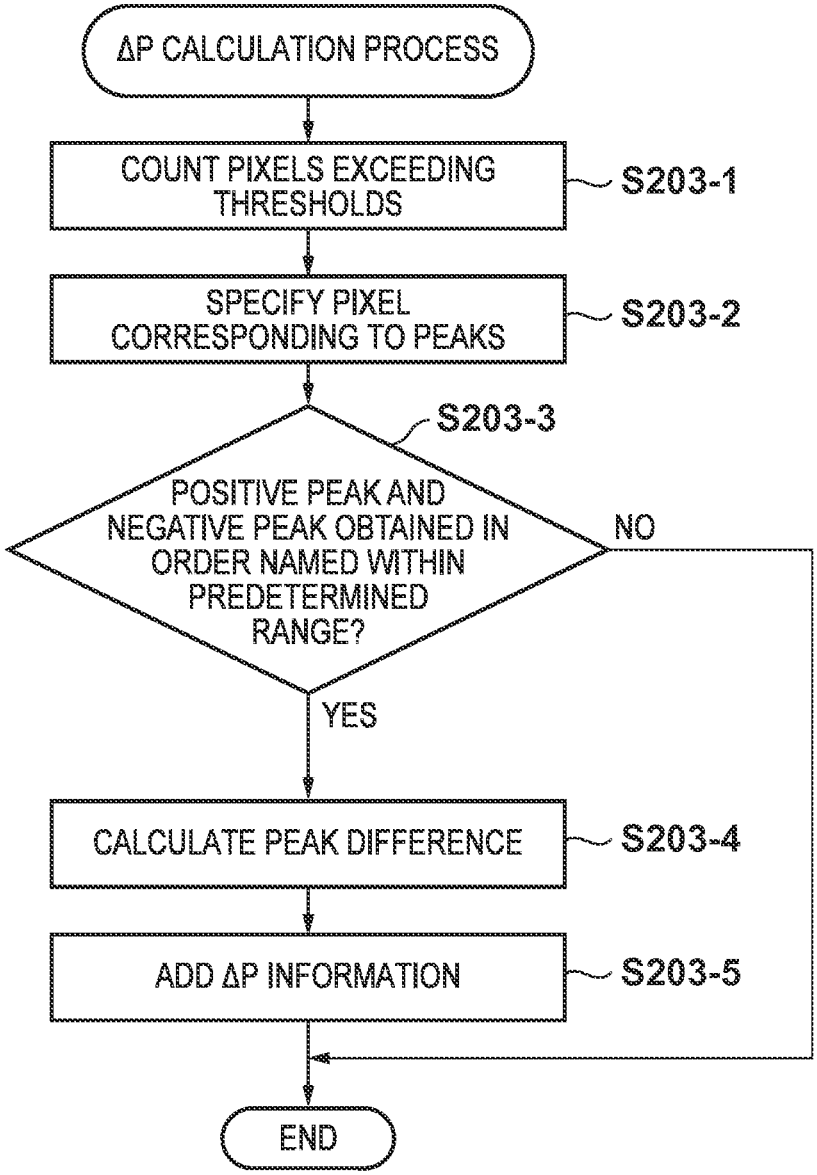
FIG. 29 is a flowchart showing a ΔP calculation process in ink dripping analysis in the sixth embodiment.
Figure 30:
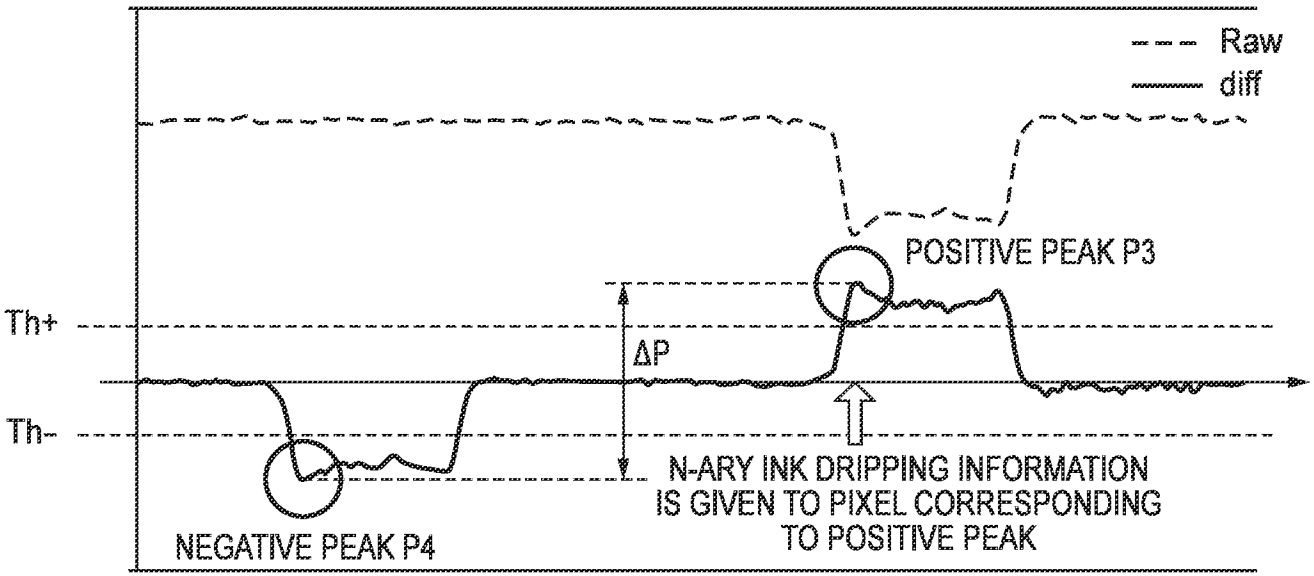
FIG. 30 is a graph for explaining an outline of ΔP in ink dripping analysis in the sixth embodiment.

FIG. 29 is a flowchart showing details of the ΔP calculation process upon ink dripping. FIG. 30 is a graph for explaining the relationship between the raw value, difference value 2, and ΔP arising from ink dripping. In FIG. 30, "Th+" is a positive threshold value in ink dripping detection, and "Th−" is a negative threshold value in ink dripping detection. Raw is the raw value calculated in step S201, and diff is the difference value calculated in step S202. Similar to step S103, the local maximum value of a calculated difference value exceeding Th+ is defined as a positive peak P3, and the local minimum value of a difference value smaller than Th− is defined as a negative peak P4. Note that "Th+" and "Th−" can be arbitrarily set in accordance with the ink type or the like.

Referring to FIG. 29, pixels exceeding these thresholds are counted in step S203-1, similar to step S103-1. More specifically, pixels smaller in the difference value than the negative threshold value Th− are searched for. If pixels smaller than Th− are detected, the local minimum value of the difference value near these pixels is searched for in step S203-2, and defined as the negative peak P4. Then, pixels exceeding Th+ are searched for near the negative peak P4. If pixels exceeding Th+ are detected, the local maximum value of the difference value near these pixels is searched for and defined as the positive peak P3. In this manner, pixels corresponding to the peaks are specified.

In step S203-3, it is checked whether the negative peak and positive peak are obtained in the order named in ascending order of the position coordinate value within a predetermined range. If it is determined that the negative peak and positive peak are obtained in the order named, it is determined that ink dripping has occurred in a pixel near the positive peak, and a peak difference value (ΔP=P3−P4) is calculated in step S203-4. In step S203-5, information of ΔP (=P3−P4) arising from ink dripping is stored in correspondence with the pixel corresponding to the positive peak.

If it is determined that the negative peak and positive peak are not obtained in the order named, the process skips steps S203-4 and S203-5 and ends without calculating ΔP. The ΔP calculation process upon ink dripping has been described.

In the sixth embodiment, when the luminance value of a raw value is 80% or more of the average value, ΔP arising from ink dripping is not calculated to prevent a detection error.

Figure 27:
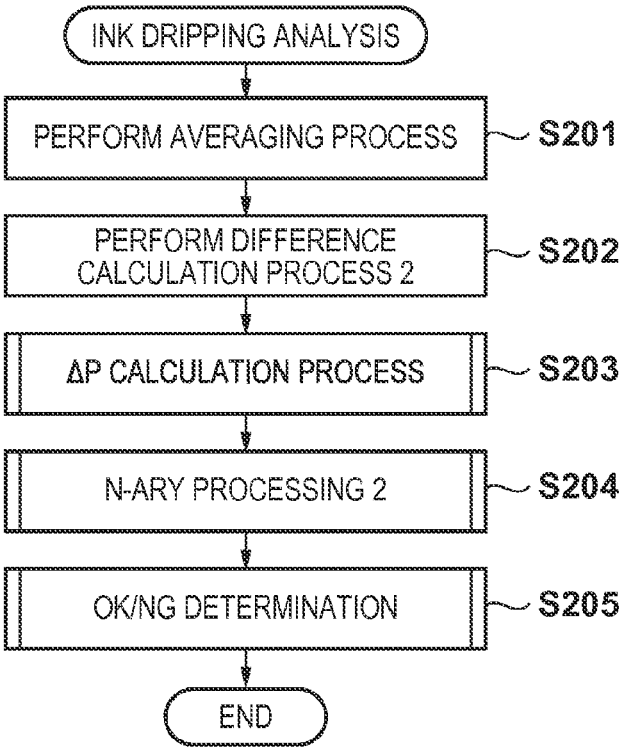
FIG. 27 is a flowchart showing ink dripping analysis in the sixth embodiment.

Thereafter, N-ary processing 2 is executed for ΔP which has been calculated in step S203 of FIG. 27 (step S204). N-ary processing 2 will be explained with reference to the flowchart of FIG. 31.

In the sixth embodiment, binarization is performed in N-ary processing for determining the presence/absence of ink dripping. More specifically, the presence/absence of ink dripping is determined by comparing the calculated ΔP with a preset threshold Fb for ΔP.

Figure 31:
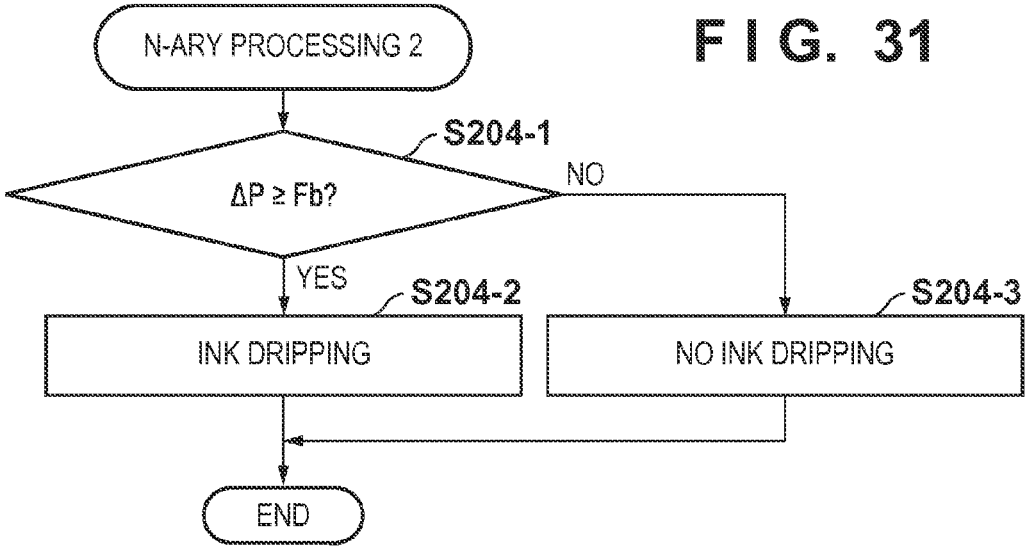
FIG. 31 is a flowchart showing N-ary processing 2 in the sixth embodiment.

Referring to FIG. 31, ΔP is compared with the threshold Fb in ink dripping analysis in step S204-1. If ΔP≥Fb, the process advances to step S204-2 to determine that ink dripping has occurred. If ΔP<Fb, the process advances to step S204-3 to determine that no ink dripping has occurred.

Referring back to FIG. 27, OK/NG is determined for analysis of ink dripping onto the inspection pattern in step S205. If no ink dripping has been detected in the process of step S204, OK is determined; if ink dripping has been detected, NG is determined. By performing ink dripping analysis, ink attached to a printing medium upon contact of the printhead with the printing medium can also be detected in addition to ink dripping onto an inspection pattern.

According to the sixth embodiment described above, both of non-discharge analysis and ink dripping analysis can be performed. Therefore, a discharge failure generated during the printing operation can be detected more accurately.

In the sixth embodiment, the analysis process is performed using ΔP obtained by calculating a difference between a local maximum value and a local minimum value in both of non-discharge analysis and ink dripping analysis. However, the ΔP accumulated value described in the second embodiment may also be used.

(Seventh Embodiment)

In the sixth embodiment, after obtaining the analysis results of both discharge failure analysis and ink dripping analysis in step S76 of FIG. 26, these analysis results are determined. In the seventh embodiment, the analysis results of discharge failure analysis and ink dripping analysis are determined respectively.

Figure 32:
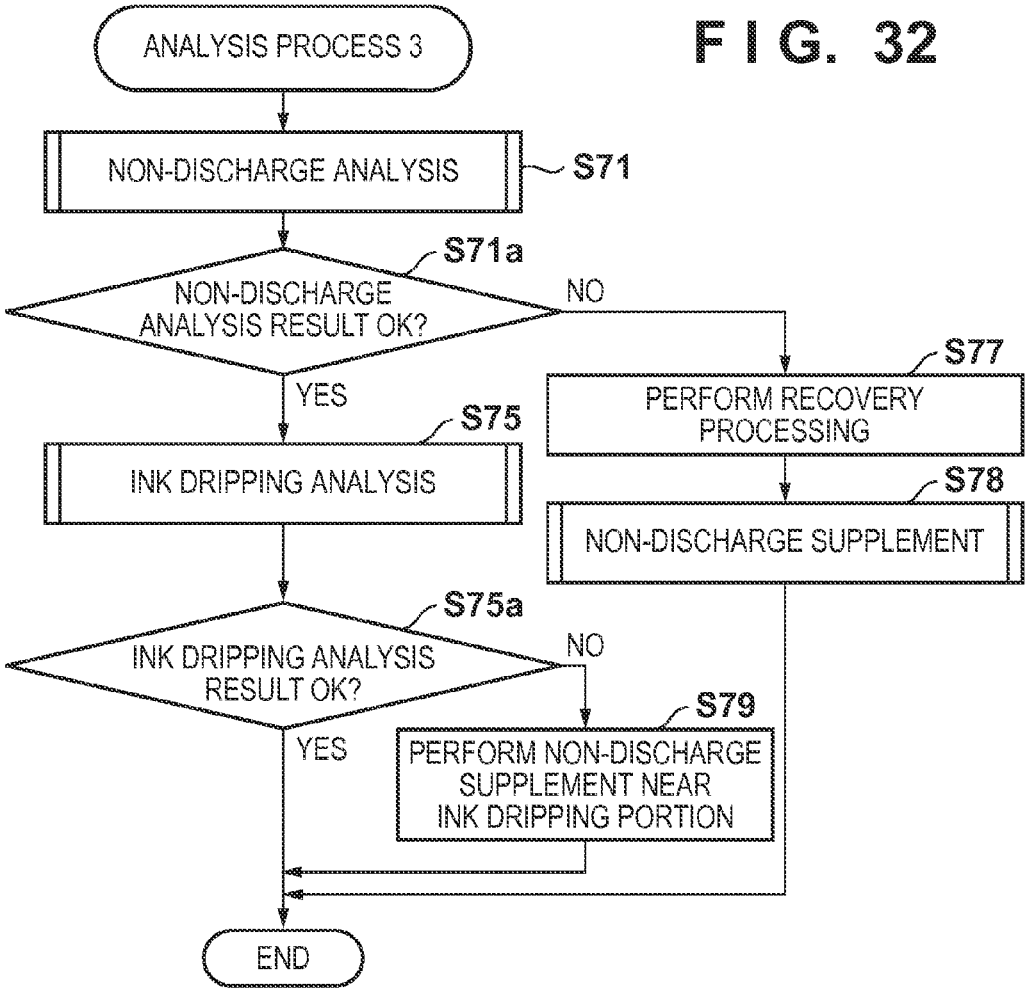
FIG. 32 is a flowchart showing analysis process 3 in the seventh embodiment.

FIG. 32 is a flowchart showing analysis process 3 according to the seventh embodiment. In FIG. 32, the same step reference numerals as those described in FIG. 26 denote the same processes, and a description thereof will not be repeated. Only processing unique to the seventh embodiment will be explained.

As is apparent from a comparison between FIGS. 32 and 26, in the seventh embodiment, OK/NG is determined for respective analysis results after the end of non-discharge analysis in step S71 and the end of ink dripping analysis in step S75.

Referring to FIG. 32, if it is determined in step S71*a* that the result of non-discharge analysis is NG, recovery processing is executed in step S77, similar to the sixth embodiment. In step S78, non-discharge supplement is performed. If it is determined in step S75*a* that the result of ink dripping analysis is NG, the process advances to step S79, and all nozzles contained in pixels in a range where difference values are positive before and after a positive peak are set as discharge failure nozzles. It is determined that a nozzle which drips ink exists in the neighboring region, and non-discharge supplement is executed. By executing non-discharge supplement, no ink is discharged from a nozzle to which dust or the like is attached, thereby preventing ink dripping onto a printing medium.

Figure 33:
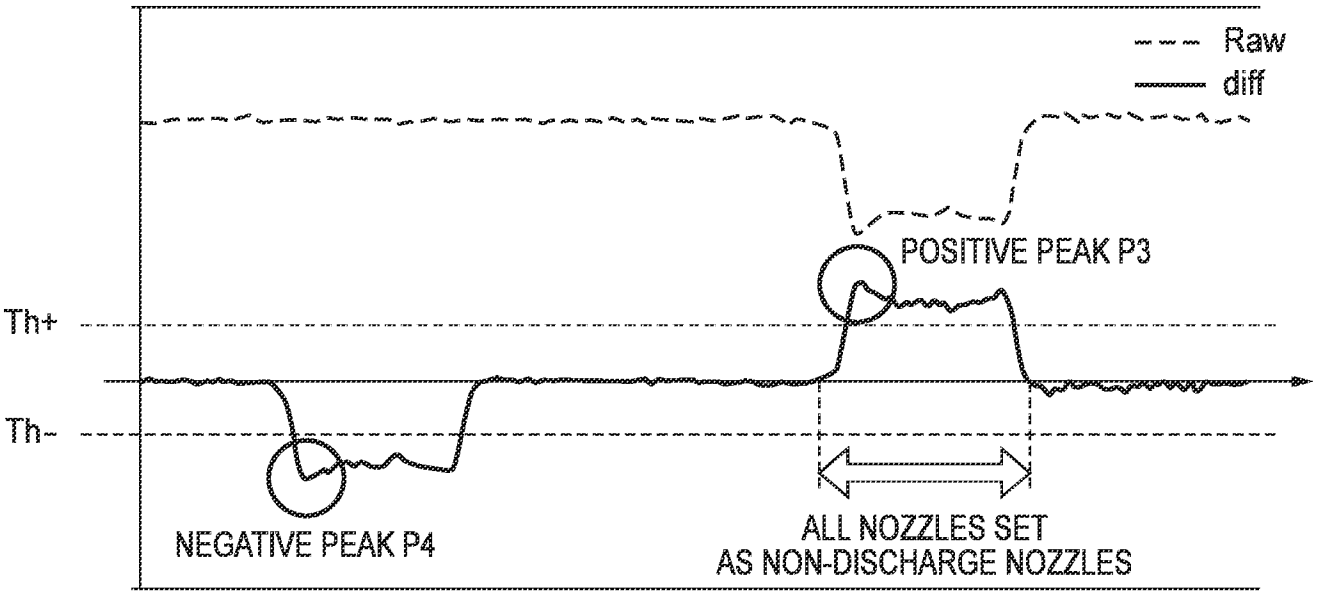
FIG. 33 is a graph for explaining a discharge failure nozzle and setting range when ink dripping occurs in the seventh embodiment.

FIG. 33 is a graph showing the relationship between the raw value, the difference value, and the range where discharge failure nozzles which may drip ink are set. FIG. 33 shows that positive difference values diff continue for a while after the positive peak P3. In step S79, nozzles in this range are set as discharge failure nozzles, and non-discharge supplement is performed.

According to the seventh embodiment described above, an appropriate measure can be taken at a proper timing, and a more efficient printing operation can be implemented.

(Eighth Embodiment)

The eighth embodiment will describe another example of a measure for the result of non-discharge analysis and a measure for the result of ink dripping analysis.

Figure 34:
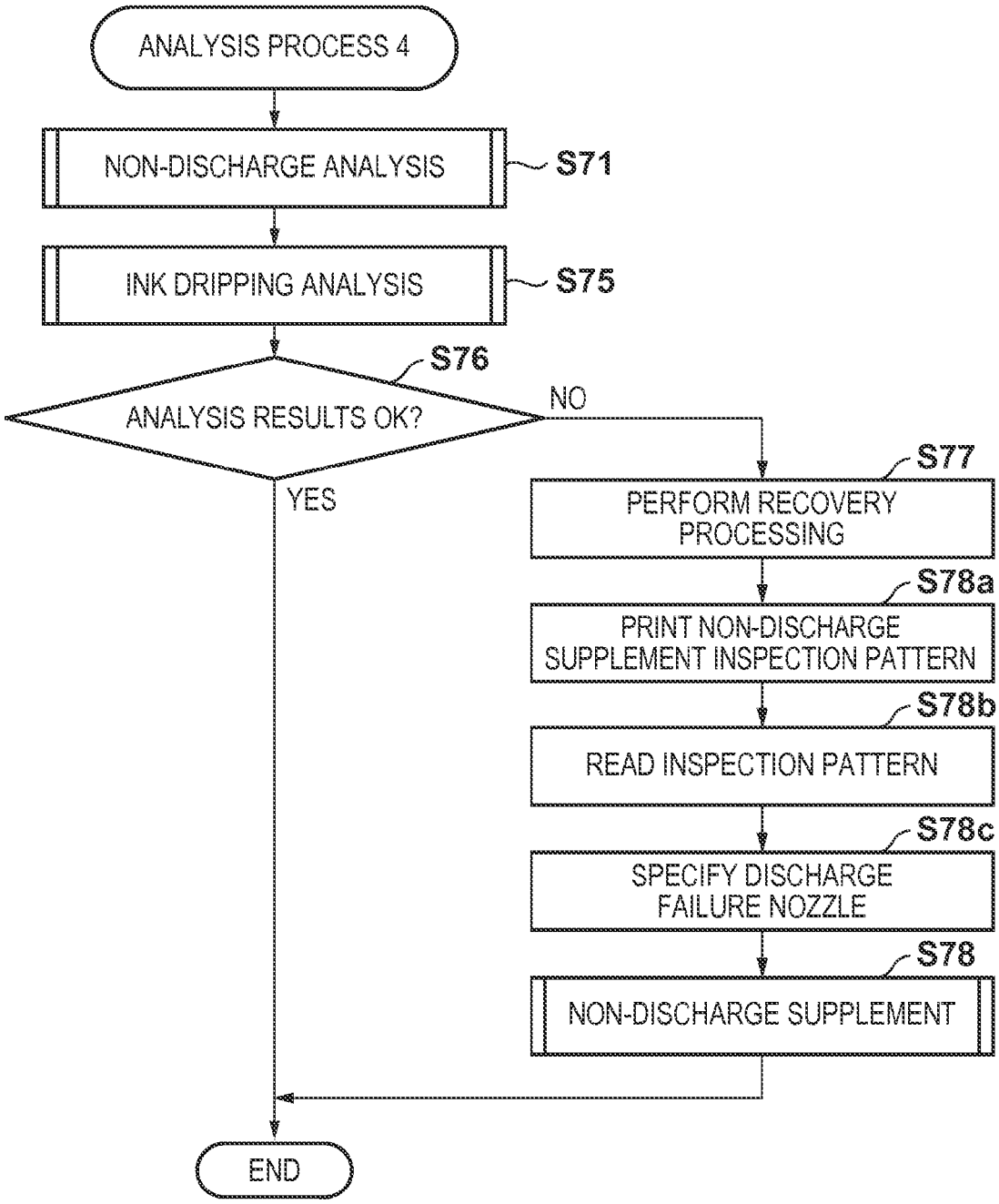
FIG. 34 is a flowchart showing analysis process 4 in the eighth embodiment.

FIG. 34 is a flowchart showing analysis process 4 according to the eighth embodiment. In FIG. 34, the same step reference numerals as those described in FIG. 26 in the sixth embodiment denote the same processing steps, and a description thereof will not be repeated. Only processing unique to the eighth embodiment will be explained.

Similar to the sixth embodiment, in steps S71, S75, and S76, a read non-discharge detection pattern 121 undergoes non-discharge analysis for detecting a discharge failure nozzle, the ink-landing position shift of an ink droplet, and the like, and ink dripping analysis for detecting ink dripped onto an inspection pattern, and the analysis results are determined. If it is determined that both of the analysis results are OK, printing continues without performing any processing. If it is determined that either analysis result is NG, printing is interrupted, and recovery processing is performed in step S77.

In step S78*a*, to accurately perform non-discharge supplement, a non-discharge supplement inspection pattern for specifying the position of a discharge failure nozzle in more detail is printed.

Figure 35:
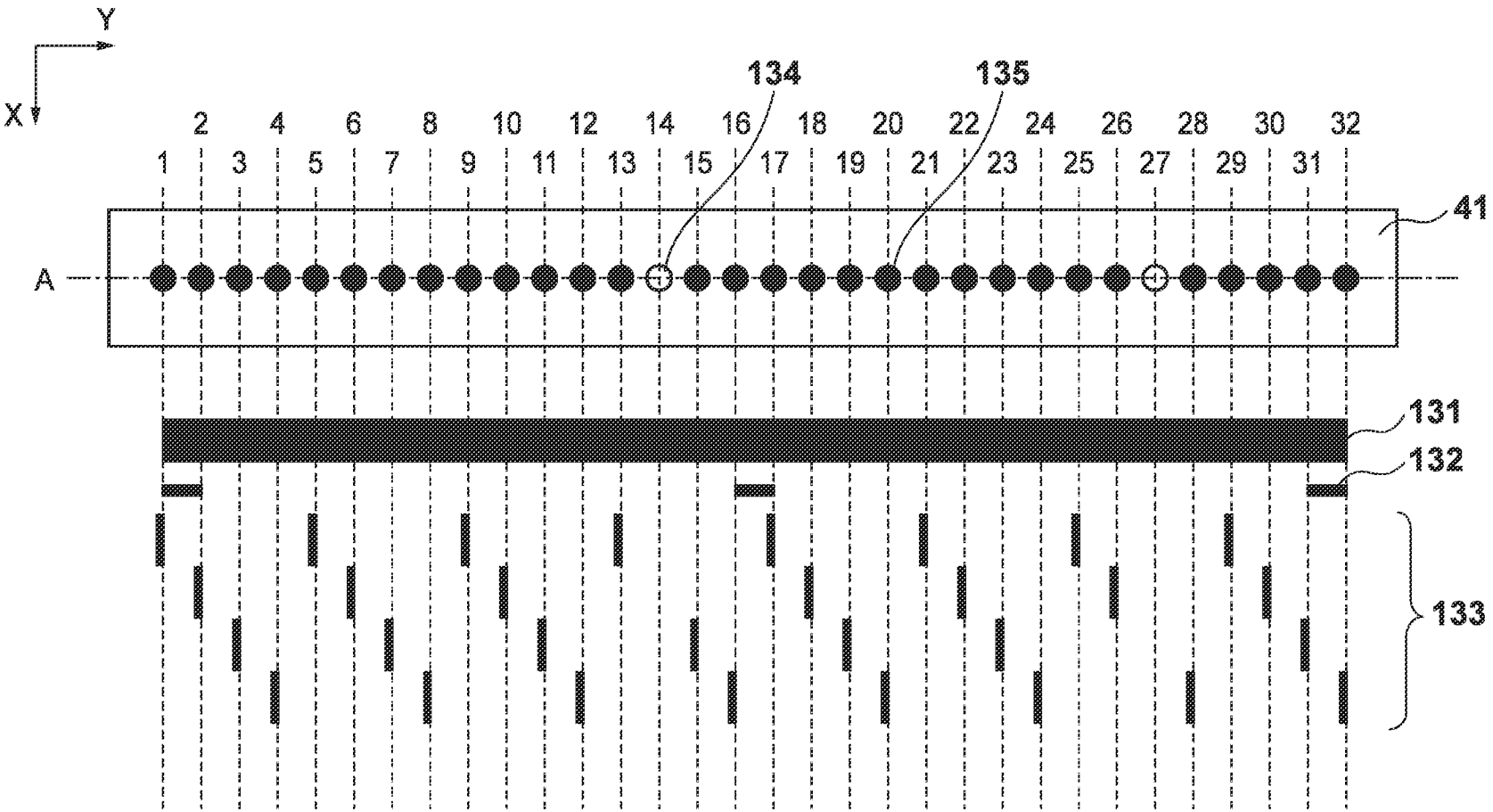
FIG. 35 is a view for explaining the relationship between the printhead and a non-discharge supplement inspection pattern in the eighth embodiment.

FIG. 35 is a view for explaining the relationship between one nozzle array in a printing chip 41 and a non-discharge supplement inspection pattern. The non-discharge supplement inspection pattern is formed from a start mark 131, alignment mark 132, and inspection pattern 133. In FIG. 35, an open circle 134 and filled circle 135 represent a discharge failure nozzle and discharge nozzle, respectively. In this example, the 14th and 27th nozzles of array A are in a discharge failure state.

The start mark 131 is used to specify the start position of the non-discharge supplement inspection pattern. The alignment mark 132 is used to specify the coarse position of a discharge failure nozzle in the Y direction. These marks are also used in preliminary discharge of each nozzle array. Note that the start mark 131 and alignment mark 132 are printed using all nozzle arrays so that they are hardly affected even if a discharge failure nozzle exists. The start mark 131 and alignment mark 132 are printed by 15 dots per nozzle at a nozzle duty of 20% using nozzles at positions used to print these two marks. That is, the start mark 131 and alignment mark 132 are printed by a total of about 60 dots at a nozzle duty of about 80% using all the four nozzle arrays.

As for the inspection pattern 133 printed as the non-discharge supplement inspection pattern, the nozzle array is divided into a plurality of groups each including a plurality of successive nozzles, and nozzles in each group are sequentially driven not to simultaneously drive adjacent nozzles. More specifically, an inspection pattern of one nozzle is printed by printing five dots per nozzle while shifting their positions at every 600 dpi in the X direction. The number of discharges per unit time for the discharge failure inspection pattern is converted into a nozzle duty of 25%.

In step S78*b*, a scanner 17 reads the non-discharge supplement inspection pattern. The reading resolution is 1,200 dpi. In step S78*c*, a discharge failure nozzle is specified by comparing the luminance value of image data obtained by the reading with a threshold. When specifying a discharge failure nozzle, the processing may be performed using the difference calculation process as described in the first embodiment, or using the peak difference of a difference value may be performed. The processing may also be performed using the accumulated value of calculated difference values as described in the second embodiment.

Finally, in step S78, non-discharge supplement is performed to print by distributing print data not to the specified discharge failure nozzle, but to a nozzle of another nozzle array.

According to the eighth embodiment described above, a discharge failure nozzle is specified using an inspection pattern for which adjacent nozzles were not simultaneously driven. Thus, the position of the discharge failure nozzle can be specified more accurately, and image quality degradation caused by generation of a discharge failure nozzle can be prevented.

In the eighth embodiment, a non-discharge supplement inspection pattern is printed by a smaller number of dots than in an inspection pattern printed first. For this reason, the position of a discharge failure nozzle can be specified at a low probability of occurrence of ink dripping. More specifically, the maximum total number of discharges per nozzle used to form a non-discharge supplement inspection pattern is 20, which is smaller than 34 in a normal inspection pattern. Thus, the probability of occurrence of ink dripping onto the inspection pattern can be reduced.

Also, recovery processing such as suction wiping is performed, and after a discharge failure which can be canceled by recovery processing does not remain, a non-discharge supplement inspection pattern is printed. The probability at which ink drips onto the non-discharge inspection pattern can be further reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2011-231098, filed Oct. 20, 2011, 2011-232123, filed Oct. 21, 2011 and 2012-210151, filed Sep. 24, 2012, which are hereby incorporated by reference herein in their entirety.

What is claimed is:

1. A printing apparatus comprising:

a printhead comprising a printing chip that includes a plurality of nozzles for discharging ink which are arranged in a first direction to form a nozzle array;

a reading unit comprising a plurality of reading elements arranged in the first direction, and configured to read an inspection pattern formed by discharging ink from the plurality of nozzles, and acquire a plurality of luminance values through the plurality of reading elements;

a calculation unit configured to calculate a plurality of difference values, wherein each difference value is calculated by calculating a difference between two luminance values, of the plurality of luminance values, which are spaced apart by a predetermined number of luminance values; and an analysis unit configured to analyze an ink discharge state of the plurality of nozzles based on the plurality of difference values.

2. The apparatus according to claim 1, wherein the analysis unit is further configured to determine a number of adjacent discharge failure nozzles, of the plurality of nozzles, based on a difference between a maximum value of a concaved-down peak and a minimum value of a concaved-up peak in a profile obtained by arraying the plurality of difference values in the first direction.

3. The apparatus according to claim 1, wherein the analysis unit is further configured to obtain (i) an approximate curve of a profile obtained by arraying the plurality of difference values in the first direction, (ii) a first area of a concaved-down portion in the approximate curve, and (iii) a second area of a concaved-up portion in the approximate curve, and further configured to determine a number of adjacent discharge failure nozzles, of the plurality of nozzles, based on the first area and the second area.

4. The apparatus according to claim 1, further comprising:

a supplement unit configured to perform a non-discharge supplement based on a result of the analysis by the analysis unit.

5. The apparatus according to claim 1, further comprising:

a recovery unit configured to perform recovery processing based on a result of the analysis by the analysis unit.

6. The apparatus according to claim 1, wherein the analysis unit is further configured to use different analysis methods for a central region of the nozzle array and an end-side region of the nozzle array in the first direction.

7. The apparatus according to claim 6, wherein the analysis unit is further configured to (i) obtain a maximum value of a concaved-down peak and a minimum value of a concaved-up peak in a profile obtained by arraying the plurality of difference values in the first direction, (ii) analyze the ink discharge state based on a difference between the maximum value and the minimum value for the central region, and (iii) analyze the ink discharge state based on one of the maximum value and the minimum value for the end-side region.

8. The apparatus according to claim 6, wherein the analysis unit is further configured to (i) obtain a maximum value of a concaved-down peak and a minimum value of a concaved-up peak in a profile obtained by arraying the plurality of difference values in the first direction, (ii) analyze the ink discharge state based on a difference between the maximum value and the minimum value for the central region, and (iii) analyze the ink discharge state based on a value obtained by multiplying a difference between the maximum value and the minimum value by a coefficient for the end-side region.

9. The apparatus according to claim 1, wherein the reading unit further comprises a CCD line sensor.

10. The apparatus according to claim 1, wherein the calculation unit is further configured to perform a second calculation process of calculating a second plurality of difference values, wherein each of the second difference values is calculated by calculating a difference between two luminance values spaced apart by a second predetermined number of luminance values different from the predetermined number of luminance values, and the analysis unit is further configured to perform a first analysis process of analyzing the ink discharge state of the plurality of nozzles based on a first profile obtained by arraying, in the first direction, the plurality of difference values, and a second analysis process of analyzing the ink discharge state of the plurality of nozzles based on a second profile obtained by arraying, in the first direction, the plurality of second difference values obtained in the second calculation process.

11. The apparatus according to claim 10, wherein the first analysis process is performed when a concaved-down peak and a concaved-up peak are aligned in a named order in the first direction, and the second analysis process is performed when a concaved-up peak and a concaved-down peak are aligned in a named order in the first direction.

12. The apparatus according to claim 1, wherein the printhead further comprises a plurality of nozzle arrays, arrayed in a direction perpendicular to the first direction.

13. The apparatus according to claim 1, wherein the printhead includes a full-line type printhead.

14. A printing method for a printing apparatus that includes a printhead comprising a printing chip that includes a plurality of nozzles for discharging ink which are arranged in a first direction to form a nozzle array, the method comprising:

forming an inspection pattern by discharging ink from the plurality of nozzles in the printhead;

reading the inspection pattern, and acquiring a plurality of luminance values arranged in the first direction;

calculating a plurality of difference values, wherein each difference value is calculated by calculating a difference between two luminance values, of the plurality of luminance values, which are spaced apart by a predetermined number of luminance values; and analyzing an ink discharge state of the plurality of nozzles based on the plurality of difference values.

15. The method according to claim 14, wherein a number of adjacent discharge failure nozzles, of the plurality of nozzles, is analyzed, in the analyzing step, based on a difference between a maximum value of a concaved-down peak and a minimum value of a concaved-up peak in a profile obtained by arraying the plurality of difference values in the first direction.

16. The method according to claim 14, wherein the analyzing further comprises:

obtaining an approximate curve of a profile obtained by arraying the plurality of difference values in the first direction;

obtaining a first area of a concaved-down region in the approximate curve;

obtaining a second area of a concaved-up region in the approximate curve; and analyzing the number of adjacent discharge failure nozzles, of the plurality of nozzles, based on the first area and the second area.

17. The method according to claim 14, wherein in the analyzing step, different analysis methods are used for a central region of the nozzle array, and an end-side region of the nozzle array in the first direction.

18. The method according to claim 14, wherein the calculating further comprises:

a second calculation process of calculating a second plurality of difference values, wherein each of the second difference values is calculated by calculating a difference between two luminance values spaced apart by a second predetermined number of luminance values different from the predetermined number of luminance values, and wherein the analyzing further comprises:

a first analysis process of analyzing the ink discharge state of the plurality of nozzles based on a first profile obtained by arraying, in the first direction, the plurality of difference values, and a second analysis process of analyzing the ink discharge state of the plurality of nozzles based on a second profile obtained by arraying, in the first direction, the plurality of second difference values obtained in the second calculation process.

19. A printing apparatus comprising:

a printhead comprising a printing chip that includes a plurality of nozzles for discharging ink which are arranged in a first direction to form a nozzle array;

a reading unit configured to read an inspection pattern formed by discharging ink from the plurality of nozzles, and acquire a plurality of luminance values through a plurality of reading elements;

a calculation unit configured to calculate a plurality of difference values, wherein each difference value is calculated by calculating a difference between two luminance values, of the plurality of luminance values, which are spaced apart by a predetermined number; and an estimation unit configured to estimate an ink discharge state of the plurality of nozzles based on the plurality of difference values.

20. The apparatus according to claim 19, wherein the estimation unit is further configured to determine a number of adjacent discharge failure nozzles, of the plurality of nozzles, based on a difference between a maximum value of a concaved-down peak and a minimum value of a concaved-up peak in a profile obtained by arraying the plurality of difference values in the first direction.

21. The apparatus according to claim 19, wherein the estimation unit is further configured to obtain (i) an approximate curve of a profile obtained by arraying the plurality of difference values in the first direction, (ii) a first area of a concaved-down portion in the approximate curve, and (iii) a second area of a concaved-up portion in the approximate curve, and further configured to determine a number of adjacent discharge failure nozzles, of the plurality of nozzles, based on the first area and the second area.

22. The apparatus according to claim 19, further comprising:

a supplement unit configured to perform a non-discharge supplement based on a result of the estimation by the estimation unit.

23. The apparatus according to claim 19, further comprising:

a recovery unit configured to perform recovery processing based on a result of the estimation by the estimation unit.

24. The apparatus according to claim 19, wherein the estimation unit is further configured to use different estimation methods for a central region of the nozzle array and an end-side region of the nozzle array in the first direction.

25. The apparatus according to claim 24, wherein the estimation unit is further configured to (i) obtain a maximum value of a concaved-down peak and a minimum value of a concaved-up peak in a profile obtained by arraying the plurality of difference values in the first direction, (ii) estimate the ink discharge state based on a difference between the maximum value and the minimum value for the central region, and (iii) estimate the ink discharge state based on one of the maximum value and the minimum value for the end-side region.

26. The apparatus according to claim 24, wherein the estimation unit is further configured to (i) obtain a maximum value of a concaved-down peak and a minimum value of a concaved-up peak in a profile obtained by arraying the plurality of difference values in the first direction, (ii) estimate the ink discharge state based on a difference between the maximum value and the minimum value for the central region, and (iii) estimate the ink discharge state based on a value obtained by multiplying a difference between the maximum value and the minimum value by a coefficient for the end-side region.

27. The apparatus according to claim 19, wherein the reading unit further comprises a CCD line sensor.

28. The apparatus according to claim 19, wherein the calculation unit is further configured to perform a second calculation process of calculating a second plurality of difference values, wherein each of the second difference values is calculated by calculating a difference between two luminance values spaced apart by a second predetermined number of luminance values different from the predetermined number of luminance values, and the estimation unit is further configured to perform a first estimation process of estimating the ink discharge state of the plurality of nozzles based on a first profile obtained by arraying, in the first direction, the plurality of difference values, and a second estimation process of estimating the ink discharge state of the plurality of nozzles based on a second profile obtained by arraying, in the first direction, the plurality of second difference values obtained in the second calculation process.

29. The apparatus according to claim 28, wherein the first estimation process is performed when a concaved-down peak and a concaved-up peak are aligned in a named order in the first direction, and the second estimation process is performed when a concaved-up peak and a concaved-down peak are aligned in a named order in the first direction.

30. The apparatus according to claim 19, wherein the printhead further comprises a plurality of nozzle arrays, arrayed in a direction perpendicular to the first direction.

31. The apparatus according to claim 19, wherein the printhead includes a full-line type printhead.

* * * * *